US006431828B1

(12) United States Patent
Quinn

(10) Patent No.: US 6,431,828 B1
(45) Date of Patent: Aug. 13, 2002

(54) NON-PLANAR ROTOR COVER FOR A CENTRIFUGAL PUMP

(75) Inventor: Joel Quinn, South Jordan, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 0 days.

(21) Appl. No.: 09/543,035

(22) Filed: Apr. 5, 2000

(51) Int. Cl.[7] ..... F04D 1/14; F04D 11/00
(52) U.S. Cl. ..... 415/182.1; 415/89
(58) Field of Search ..... 415/88, 89, 182.1, 415/227, 224

(56) References Cited

U.S. PATENT DOCUMENTS 700,224 A * 5/1902 McRae ..... 415/88 X
1,986,836 A * 1/1935 MacNeille ..... 415/88 X
2,318,293 A * 5/1943 Cornell ..... 415/89 X
3,049,081 A * 8/1962 Singlemann ..... 415/89
3,244,109 A * 4/1966 Barske ..... 415/227 X
3,307,485 A * 3/1967 Logue ..... 415/88
3,748,054 A * 7/1973 Eskeli ..... 415/80
3,784,317 A * 1/1974 Lewis ..... 415/89 X
3,822,102 A 7/1974 Erickson et al.
3,828,573 A * 8/1974 Eskeli ..... 415/88 X
3,960,319 A 6/1976 Brown et al.
4,161,448 A 7/1979 Erickson et al.
4,280,790 A 7/1981 Critchlow
4,332,521 A 6/1982 Erickson
4,674,950 A 6/1987 Erickson ..... 415/88

* cited by examiner

*Primary Examiner*—John E. Ryznic
(74) *Attorney, Agent, or Firm*—Morriss, Bateman, O'Bryant & Compagni

(57) ABSTRACT

A rotor assembly for a centrifugal pump is configured with at least one non-planar outer surface, in either the rotor cover or the rotor, or both, to produce centrifugal forces which exert an inward force on the rotor cover and/or rotor to counterbalance centrifugal pressures and suction pressures exerted on the rotor assembly from within the rotor chamber which cause deleterious deflections of the rotor assembly, thereby limiting the operational speed of the pump, limiting suction pressure and accelerating degradation of the seals associated with the rotor cover.

26 Claims, 18 Drawing Sheets

| ROTOR COVER RATIO | | |
|---|---|---|
| @ 2° | X/Y | 57.28 = 1 |
| @ 4° | X/Y | 28.59 = 1 |
| @ 6° | X/Y | 19.03 = 1 |
| @ 8° | X/Y | 14.23 = 1 |
| @ 10° | X/Y | 11.34 = 1 |
| @ 12° | X/Y | 9.41 = 1 |
| @ 14° | X/Y | 8.02 = 1 |
| @ 16° | X/Y | 6.98 = 1 |
| @ 18° | X/Y | 6.15 = 1 |
| @ 20° | X/Y | 5.49 = 1 |
| @ 22° | X/Y | 4.95 = 1 |
| @ 24° | X/Y | 4.49 = 1 |
| @ 26° | X/Y | 4.10 = 1 |
| @ 28° | X/Y | 3.76 = 1 |

| ROTOR RATIO | | |
|---|---|---|
| @ 10° | X/Y | 11.34 = 1 |
| @ 12° | X/Y | 9.41 = 1 |
| @ 14° | X/Y | 8.02 = 1 |
| @ 16° | X/Y | 6.98 = 1 |
| @ 18° | X/Y | 6.15 = 1 |
| @ 20° | X/Y | 5.49 = 1 |
| @ 22° | X/Y | 4.95 = 1 |
| @ 24° | X/Y | 4.49 = 1 |
| @ 26° | X/Y | 4.10 = 1 |
| @ 28° | X/Y | 3.76 = 1 |

RPM and Pressure vs. Displacement for Cover
DISPLACEMENT TABLE

1000 rpm

| height/dia | | 0.01745 | 0.03488 | 0.05226 | ** 0.06959 | 0.08682 | 0.10396 | *** 0.12096 | 0.13782 | 0.17101 | 0.20337 | 0.23474 |
|---|---|---|---|---|---|---|---|---|---|---|---|---|
| PRESSURE | 0° | 2° | 4° | 6° | 8° | 10° | 12° | 14° | 16° | 20° | 24° | 28° |
| 0 | 0.002145 | 0.001543 | 0.000998 | 0.000614 | 0.000365 | 0.000196 | 9.694E-05 | 3.59E-05 | -1.33E-05 | -4.71E-05 | -5.33E-05 | -4.84E-05 |
| 100 | 0.002629 | 0.001963 | 0.001347 | 0.000906 | 0.000612 | 0.000407 | 0.0002837 | 0.000204 | 0.000139 | 8.73E-05 | 6.9E-05 | 6.63E-05 |
| 200 | 0.00311 | 0.002388 | 0.001696 | 0.001198 | 0.000859 | 0.000618 | 0.0004694 | 0.000371 | 0.000292 | 0.00022 | 0.00019 | 0.000181 |
| 300 | 0.003594 | 0.002816 | 0.002045 | 0.00149 | 0.001106 | 0.000829 | 0.0006551 | 0.000541 | 0.000443 | 0.000353 | 0.000312 | 0.000294 |
| 400 | 0.00408 | 0.003224 | 0.002396 | 0.001782 | 0.001269 | 0.001041 | 0.0008429 | 0.000706 | 0.000594 | 0.000484 | 0.000433 | 0.000408 |

3000 rpm

| PRESSURE | 0° | 2° | 4° | 6° | ** 8° | 10° | 12° | *** 14° | 16° | 20° | 24° | 28° |
|---|---|---|---|---|---|---|---|---|---|---|---|---|
| 0 | 0.019304 | 0.013886 | 0.008982 | 0.005529 | 0.003284 | 0.001763 | 0.0008724 | 0.000323 | -0.000119 | -0.000424 | -0.000479 | -0.000435 |
| 100 | 0.023657 | 0.017669 | 0.012122 | 0.008155 | 0.00551 | 0.003664 | 0.0025531 | 0.001837 | 0.001254 | 0.000786 | 0.000621 | 0.000597 |
| 200 | 0.027992 | 0.02149 | 0.015263 | 0.010782 | 0.007733 | 0.005565 | 0.0042245 | 0.003343 | 0.002627 | 0.001984 | 0.001712 | 0.001627 |
| 300 | 0.032345 | 0.025347 | 0.018404 | 0.013408 | 0.009955 | 0.007457 | 0.0058959 | 0.004867 | 0.003986 | 0.003178 | 0.00281 | 0.002645 |
| 400 | 0.036716 | 0.02902 | 0.021563 | 0.016035 | 0.011424 | 0.009367 | 0.0075857 | 0.006355 | 0.005345 | 0.004353 | 0.003894 | 0.003673 |

5000 rpm

| PRESSURE | 0° | 2° | 4° | 6° | ** 8° | 10° | 12° | *** 14° | 16° | 20° | 24° | 28° |
|---|---|---|---|---|---|---|---|---|---|---|---|---|
| 0 | 0.053622 | 0.038571 | 0.024949 | 0.015357 | 0.009122 | 0.004898 | 0.0024235 | 0.000898 | -0.000332 | -0.001179 | -0.001332 | -0.001209 |
| 100 | 0.065714 | 0.049082 | 0.033673 | 0.022653 | 0.015306 | 0.010179 | 0.0070918 | 0.005102 | 0.003485 | 0.002184 | 0.001724 | 0.001658 |
| 200 | 0.077755 | 0.059694 | 0.042398 | 0.029949 | 0.02148 | 0.015459 | 0.0117347 | 0.009286 | 0.007296 | 0.00551 | 0.004755 | 0.00452 |
| 300 | 0.089847 | 0.070408 | 0.051122 | 0.037245 | 0.027653 | 0.020714 | 0.0163776 | 0.01352 | 0.011071 | 0.008827 | 0.007806 | 0.007347 |
| 400 | 0.10199 | 0.080612 | 0.059898 | 0.044541 | 0.031735 | 0.02602 | 0.0210714 | 0.017653 | 0.014847 | 0.012092 | 0.010816 | 0.010204 |

7000 rpm

| PRESSURE | 0° | 2° | 4° | 6° | ** 8° | 10° | 12° | *** 14° | 16° | 20° | 24° | 28° |
|---|---|---|---|---|---|---|---|---|---|---|---|---|
| 0 | 0.1051 | 0.0756 | 0.0489 | 0.0301 | 0.01788 | 0.0096 | 0.00475 | 0.00176 | -0.00065 | -0.00231 | -0.00261 | -0.00237 |
| 100 | 0.1288 | 0.00962 | 0.066 | 0.0444 | 0.03 | 0.01995 | 0.0139 | 0.01 | 0.00683 | 0.00428 | 0.00338 | 0.00325 |
| 200 | 0.1524 | 0.117 | 0.0831 | 0.0587 | 0.0421 | 0.0303 | 0.023 | 0.0182 | 0.0143 | 0.0108 | 0.00932 | 0.00886 |
| 300 | 0.1761 | 0.138 | 0.1002 | 0.073 | 0.0542 | 0.0406 | 0.0321 | 0.0265 | 0.0217 | 0.0173 | 0.0153 | 0.0144 |
| 400 | 0.1999 | 0.158 | 0.1174 | 0.0873 | 0.0622 | 0.051 | 0.0413 | 0.0346 | 0.0291 | 0.0237 | 0.0212 | 0.02 |

*Fig. 15*

RPM and Pressure vs. Displacement for Rotor and Cover
DISPLACEMENT TABLE

1000 rpm

| | | | | | | | | | | | | |
|---|---|---|---|---|---|---|---|---|---|---|---|---|
| height/dia | | 0.03492 | 0.06993 | 0.10510 | 0.14054 | 0.17633 | 0.21256 | 0.24933 | 0.28675 | 0.36397 | 0.44523 | 0.53171 |
| height | | 0.30992 | 0.62060 | 0.93280 | 1.24730 | 1.56490 | 1.88644 | 2.21279 | 2.54487 | 3.23024 | 3.95140 | 4.71892 |
| PRESSURE | 0° | 2° | 4° | 6° | 8° | 10° | 12° | 14° | 16° | 20° | 24° | 28° |
| 0 | 0 | 0.002851 | 0.001804 | 0.001051 | 0.000527 | 0.000182 | -4.082E-05 | -0.00019 | -0.000278 | -0.000359 | -0.000376 | -0.000361 |
| 100 | 0 | 0.003306 | 0.002157 | 0.001316 | 0.000724 | 0.000329 | 7.061E-05 | -0.000104 | -0.000212 | -0.000318 | -0.000349 | -0.000343 |
| 200 | 0 | 0.003765 | 0.00251 | 0.00158 | 0.00092 | 0.000476 | 0.0001816 | -1.84E-05 | -0.000148 | -0.00028 | -0.000322 | -0.000324 |
| 300 | 0 | 0.00422 | 0.002861 | 0.001845 | 0.001118 | 0.000622 | 0.0002939 | 6.55E-05 | -8.16E-05 | -0.000239 | -0.000295 | -0.000306 |
| 400 | 0 | 0.004678 | 0.003214 | 0.002108 | 0.001316 | 0.000769 | 0.000402 | 0.000151 | -1.63E-05 | -0.000198 | -0.000267 | -0.000288 |

3000 rpm

| PRESSURE | 0° | 2° | 4° | 6° | 8° | 10° | 12° | 14° | 16° | 20° | 24° | 28° |
|---|---|---|---|---|---|---|---|---|---|---|---|---|
| 0 | 0 | 0.025659 | 0.016237 | 0.009459 | 0.004739 | 0.001638 | -0.0003673 | -0.001708 | -0.002498 | -0.003233 | -0.00338 | -0.003251 |
| 100 | 0 | 0.029755 | 0.019414 | 0.011847 | 0.00652 | 0.002957 | 0.0006355 | -0.000937 | -0.00191 | -0.002865 | -0.003141 | -0.003086 |
| 200 | 0 | 0.033888 | 0.022592 | 0.014216 | 0.008284 | 0.00428 | 0.0016347 | -0.000165 | -0.001328 | -0.002515 | -0.002902 | -0.00292 |
| 300 | 0 | 0.037984 | 0.025751 | 0.016604 | 0.010065 | 0.005602 | 0.0026449 | 0.00059 | -0.000735 | -0.002149 | -0.002652 | -0.002755 |
| 400 | 0 | 0.042098 | 0.028929 | 0.018973 | 0.011847 | 0.006924 | 0.0036184 | 0.001359 | -0.000147 | -0.001782 | -0.002406 | -0.00259 |

5000 rpm

| PRESSURE | 0° | 2° | 4° | 6° | 8° | 10° | 12° | 14° | 16° | 20° | 24° | 28° |
|---|---|---|---|---|---|---|---|---|---|---|---|---|
| 0 | 0 | 0.071276 | 0.045102 | 0.026276 | 0.013163 | 0.004551 | -0.0010204 | -0.004745 | -0.006939 | -0.00898 | -0.009388 | -0.009031 |
| 100 | 0 | 0.082653 | 0.053929 | 0.032908 | 0.018112 | 0.008214 | 0.0017653 | -0.002602 | -0.005306 | -0.007959 | -0.008724 | -0.008571 |
| 200 | 0 | 0.094133 | 0.062755 | 0.03949 | 0.02301 | 0.011888 | 0.0045408 | -0.000459 | -0.003689 | -0.00699 | -0.008061 | -0.008112 |
| 300 | 0 | 0.10551 | 0.071531 | 0.046122 | 0.027959 | 0.015561 | 0.0073469 | 0.001638 | -0.002041 | -0.005969 | -0.007367 | -0.007653 |
| 400 | 0 | 0.116939 | 0.080357 | 0.052704 | 0.032908 | 0.019235 | 0.010051 | 0.003776 | -0.000408 | -0.004949 | -0.006684 | -0.007194 |

7000 rpm

| PRESSURE | 0° | 2° | 4° | 6° | 8° | 10° | 12° | 14° | 16° | 20° | 24° | 28° |
|---|---|---|---|---|---|---|---|---|---|---|---|---|
| 0 | | 0.1397 | 0.0884 | 0.0515 | 0.0258 | 0.00892 | -0.002 | -0.0093 | -0.0136 | -0.0176 | -0.0184 | -0.0177 |
| 100 | | 0.162 | 0.1057 | 0.0645 | 0.0355 | 0.0161 | 0.00346 | -0.0051 | -0.0104 | -0.0156 | -0.0171 | -0.0168 |
| 200 | | 0.1845 | 0.123 | 0.0774 | 0.0451 | 0.0233 | 0.0089 | -0.0009 | -0.00723 | -0.0137 | -0.00158 | -0.0159 |
| 300 | | 0.2068 | 0.1402 | 0.0904 | 0.0548 | 0.0305 | 0.0144 | 0.00321 | -0.004 | -0.0117 | -0.01444 | -0.015 |
| 400 | | 0.2292 | 0.1575 | 0.1033 | 0.0645 | 0.0377 | 0.0197 | 0.0074 | -0.0008 | -0.0097 | -0.0131 | -0.0141 |

*Fig. 20*

NON-PLANAR ROTOR COVER FOR A CENTRIFUGAL PUMP

BACKGROUND OF THE INVENTION

1. Field of the Invention

This invention relates to industrial pumps of the centrifugal type, and specifically relates to a rotor assembly of a pump which is configured to counteract deleterious centrifugal forces exerted from within the rotor assembly and thereby improve seal life and increase allowable suction pressures.

2. Description of the Related Art

Centrifugal pumps are well known and widely used in a variety of industries to pump fluids or liquid/solid components of fluid mixtures. Centrifugal pumps, particularly those of the pitot tube type, generally comprise a pump housing having an inlet and an outlet and a rotor assembly which rotates within the pump housing by means of a drive unit. More specifically, the rotor assembly comprises a rotor, sometimes called a "drum," and a rotor cover which attaches to the rotor to form a rotor chamber within which a pitot tube, or pickup tube, is stationarily positioned. Fluid is directed through the pump inlet into the rotor chamber and as the rotor assembly rotates, the fluid is directed toward the inner periphery of the rotor chamber as a result of centrifugal forces. The fluid is intercepted by the stationary pitot tube and fluid moves through the inlet of the pitot tube and toward the outlet of the pump for discharge.

Typical centrifugal pumps of the pitot tube type are disclosed in U.S. Pat. No. 3,822,102 to Erickson, et al., U.S. Pat. No. 3,960,319 to Brown, et al., U.S. Pat. No. 4,161,448 to Erickson, et al., U.S. Pat. No. 4,280,790 to Crichlow, U.S. Pat. No. 4,332,521 to Erickson and U.S. Pat. No. 4,674,950 to Erickson. In the pumps disclosed in the referenced patents, a rotor assembly generally comprises a first rotor member, sometimes referred to as the "drum," which is attached to a drive unit, and a rotor cover which is secured to the first rotor member to provide an inner rotor chamber. A central opening is formed in the rotor cover through which the stationary pitot tube extends. Most conventional rotor covers are flat, or planar, as measured from the hub of the rotor cover to the peripheral edge of the cover. That is, the hub and the peripheral edge of the rotor cover lie in a common plane which is perpendicular to a plane directed along the longitudinal axis of the rotor assembly.

The conventional planar configuration of rotor assemblies, and particularly rotor covers, has been dictated in large part by manufacturing considerations since planar rotors and rotor covers are easier to cast and machine. However, conventional rotors and rotor covers are subject to axial deflection within the pump casing as a result of forces exerted by fluid on the rotor chamber. That is, suction pressures and centrifugal pressures exerted by the fluid against the walls of the rotor chamber, especially against the circumferential wall of the rotor chamber, cause the rotor to expand radially outwardly. A corresponding axial deflection occurs in the rotor cover and the end of the rotor opposite the rotor cover. The axial deflection or movement of the rotor end and rotor cover increases as the rotational speed of the rotor assembly increases. The resulting axial deflection or movement of the rotor assembly exerts pressure on the seals associated with the rotor cover and not only limits rotational speeds in the rotor assembly, but also degrades the seals, thereby shortening the serviceable life of the seals. Further, the resulting deflection of the rotor assembly limits the suction pressures within the rotor chamber.

The alteration of the rotor assembly experienced in conventional pitot tube pumps as a result of inefficient design limits the operating speed of the pump. High rotational speeds and high suction pressures are typically not achievable in conventional rotor assembly designs without accelerated degradation of the seals associated with the rotor assembly.

Thus, it would be advantageous to provide a rotor assembly for a pump which is configured to resist axial deflection in the rotor cover and rotor end to thereby enable the pump to be operated at higher speeds with little or no reduction in suction pressure and with no degradation of the seals associated with the rotor assembly.

BRIEF SUMMARY OF THE INVENTION

In accordance with the present invention, a rotor assembly for a centrifugal pump is configured to counterbalance the centrifugal forces exerted on the rotor assembly to limit axial deflection of the rotor and rotor cover. The rotor assembly disclosed herein is adaptable to any number of centrifugal pump designs for use in a variety of applications, but is described herein with respect to pitot tube pump designs as merely one exemplary application.

The rotor assembly of the present invention generally comprises a rotor member structured to be secured to a drive unit, such as the drive shaft of a motor, to impart rotation to the rotor assembly. The rotor member, the interior of which is generally bowl-shaped, has an end wall to which the drive unit is attached and an upstanding circumferential wall extending from the end wall. The rotor assembly also includes a rotor cover which is circumferentially sized to approximate the circumference of the rotor member and is attached to the rotor member along the circumferential wall thereof. The rotor member and attached rotor cover provide a rotor chamber into which fluid for processing is introduced during operation of the pump. The rotor assembly is sized to be received within the housing of a centrifugal pump and is rotatable therein.

The rotor assembly of the present invention is particularly configured to counterbalance the centrifugal pressures and suction pressures exerted by fluid within the rotor chamber which causes the rotor assembly to expand radially and the end wall and/or rotor cover to deflect axially, as described previously with respect to conventional rotor assemblies. Specifically, at least one end (i.e., the end wall or rotor cover) of the rotor assembly is configured to be non-planar in structure such that as centrifugal pressures exerted on the circumferential wall of the rotor member radially expand the rotor assembly, deflection of the configured end wall and/or rotor cover is limited or prevented.

As used herein, "non-planar" means that the rotor cover is angled from near the central axis of the rotor cover toward the circumferential surface of the rotor assembly in the direction of the rotor member end wall or, similarly, the rotor member end wall is angled from near the central axis of the rotor member toward the circumferential surface of the rotor assembly in the direction of the rotor cover. Thus, "non-planar" is meant to include an end wall or rotor cover which is conical in shape or and end wall or rotor cover the outward facing surface of which is arcuate or curved. Either the end wall or the rotor cover may be non-planar, or both may be non-planar in configuration. It may be preferred that the especially configured end wall or rotor cover be uniformly shaped (i.e., non-planar) along the outward facing surface and inward facing surface thereof such that the thickness of the end wall or rotor cover, from a point near the central axis thereof to near the circumferential wall or peripheral surface of the rotor assembly, is substantially uniform in thickness. By "substantially uniform" is meant that the hub portion of the end wall or rotor cover (i.e., that area surrounding the central axis of the end wall or rotor cover) and/or the peripheral region of the end wall or rotor cover, and the region extending therebetween, may be comparatively more or less thick to provide stability to the rotor assembly.

The advantages realized in the configuration of the rotor assembly of the present invention are better understood in reference to the drawings and detailed description set forth hereinafter.

BRIEF DESCRIPTION OF THE SEVERAL VIEWS OF THE DRAWINGS

In the drawings, which illustrate what is current considered to be the best mode for carrying out the invention:

FIG. 15 is a chart summarizing the data shown in FIGS. 11–14;

FIG. 20 is a chart summarizing the data shown in FIGS. 16–19.

DETAILED DESCRIPTION OF THE INVENTION

Figure 1:
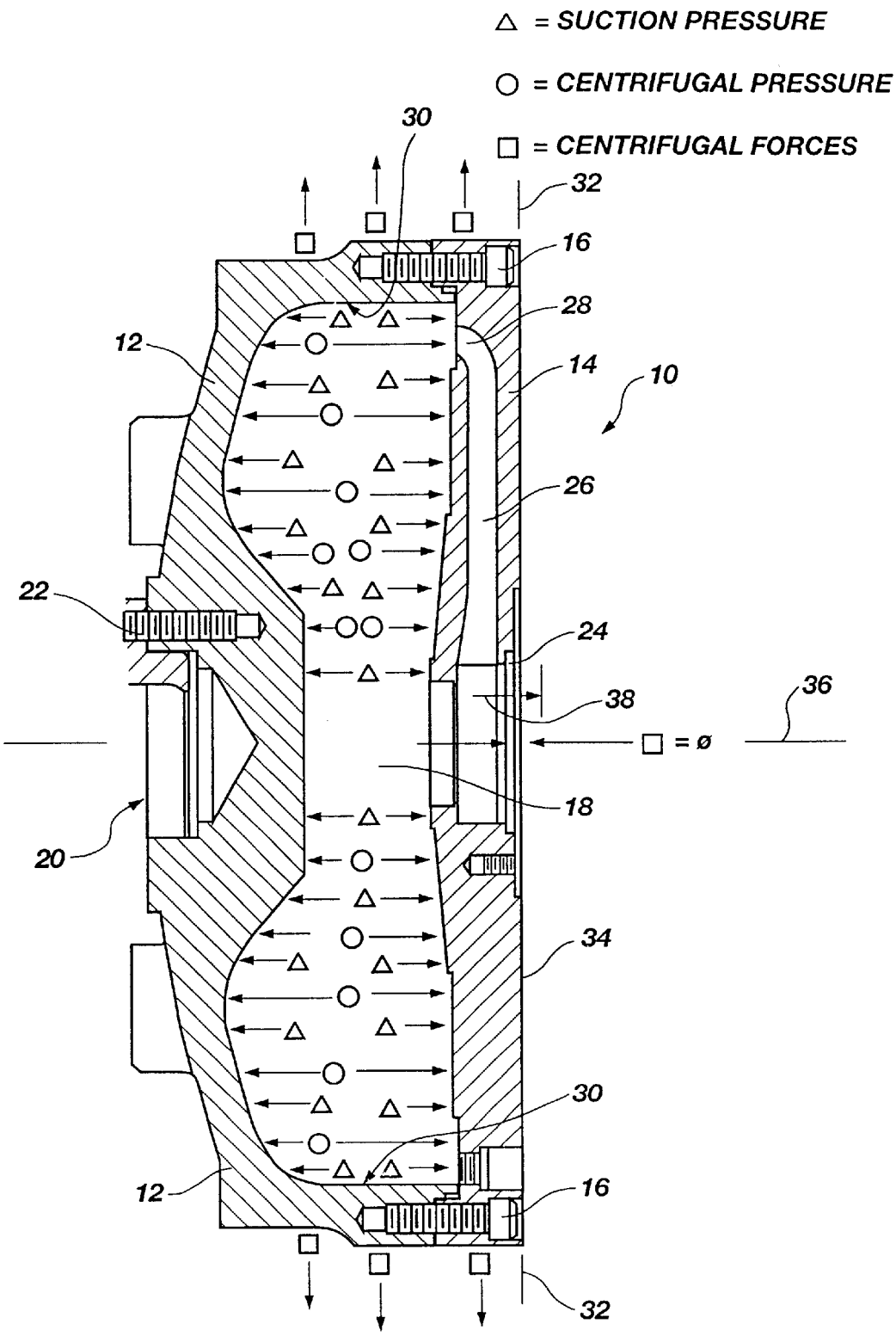
Fig. 1 (PRIOR ART)
FIG. 1 is a schematic representation of a conventional rotor and rotor cover illustrating the centrifugal forces exerted on the rotor assembly during operation.

FIG. 1 illustrates schematically the cross sectional view of a conventional rotor assembly 10 of a centrifugal pump of the pitot tube type. The rotor assembly 10 comprises a rotor member 12 and a rotor cover 14 which attaches to the rotor member by means such as bolts 16. The attachment of the rotor cover 14 to the rotor member 12 forms a rotor chamber 18 in which fluid is processed. The rotor member 12 is generally bowl-shaped and is structured to attach to a drive unit 20, such as a drive shaft or motor coupling. The rotor member 12 is secured to the drive unit 20 by some means, such as bolts 22. The rotor cover 14 is generally disk-shaped and, in a rotor assembly 10 for a pitot tube pump of the type shown, has an opening 24 formed in the center thereof through which the arm (not shown) of a pitot tube assembly is positioned. The outer diameter of a portion of the pitot tube arm which extends through the opening 24 is generally smaller than the internal diameter of the opening 24 formed through the rotor cover 14, thereby providing a space between the pitot tube assembly and the opening in the rotor cover 14 through which fluid is directed. The fluid is thereafter directed through a plurality of fluid channels 26 formed through the thickness of the rotor cover 14 and is directed through a terminal opening 28 of each fluid channel 26 into the rotor chamber 18.

In operation, the drive unit 20 causes the rotor assembly 10 to rotate while the pitot tube assembly remains stationary. Rotation of the rotor assembly 10 forces the fluid entering the rotor chamber 18 to be directed toward the circumferential wall 30 of the rotor chamber 18. The centrifugal pressures exerted on the rotor chamber 18 by the fluid are illustrated schematically in FIG. 1. At the same time, suction pressures and centrifugal pressures are exerted by the fluid against the rotor chamber 18 walls as illustrated schematically in FIG. 1.

In conventional rotor assemblies of the type shown in FIG. 1 where the rotor cover 14 is essentially planar (i.e., a plane 32 formed through the outer surface 34 of the rotor cover 14 is perpendicular to a plane extending along the central axis 36 of the rotor assembly 10), the pressures and forces exerted by the processed fluid cause the rotor assembly to expand radially outwardly which, in turn, causes the rotor cover 14 to deflect outwardly, in the direction of arrow 38. Outward deflection of the rotor cover 14 exerts excessive pressure on the seals associated with the rotor assembly, as described more fully hereinafter, which accelerates degradation of the seals and reduces the speed at which the pump can be operated. A similar deflection is also experienced in the rotor member 12.

Figure 2:
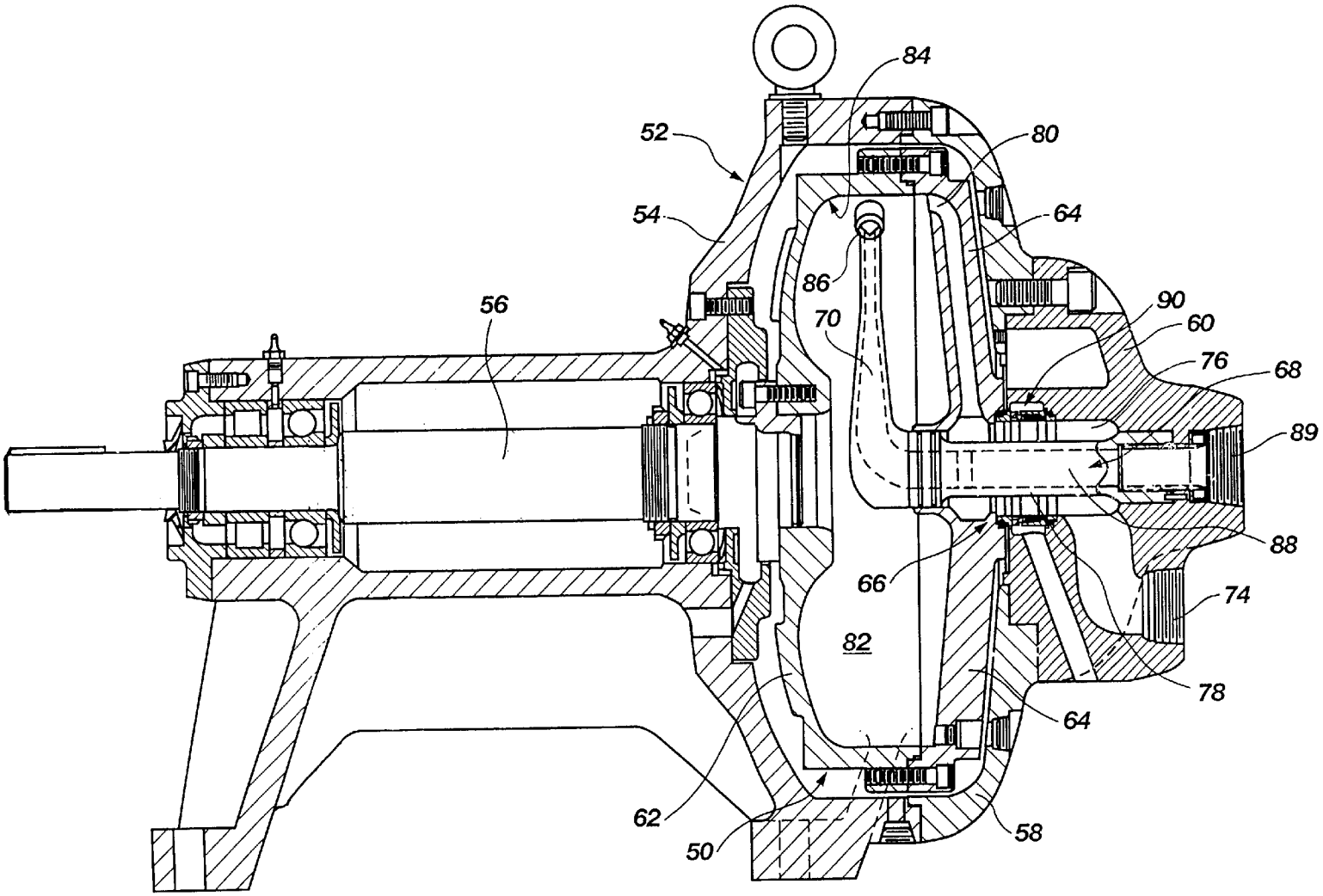
FIG. 2 is a view in longitudinal cross section of one exemplar rotor assembly of the present invention as housed within a pump casing.

Having described the problems which occur in conventional rotor assemblies, FIG. 2 illustrates a rotor assembly 50 of the present invention which is especially configured to counterbalance the forces and pressures naturally exerted on the rotor assembly during operation. The rotor assembly 50 of the present invention is shown positioned within a pump casing 52, the configuration of which may vary. The pump casing 52 generally comprises a drive-side casing 54 through which the drive shaft 56 of a motor extends to rotate the rotor assembly 50. The pump casing 52 further comprises an end bell 58, attached to the drive-side casing 54, and a manifold 60 attached to the end bell 58. The rotor assembly 50 is housed within the pump casing 52.

The rotor assembly 50 of the present invention comprises a rotor member 62, which is secured to the drive shaft 56, and a rotor cover 64, which is attached to the rotor member 62. When configured for use in a pitot tube-type centrifugal pump, as shown, the rotor cover 64 is structured with an opening 66 through which a pitot tube assembly 68, including a pitot tube 70, or pickup tube, extends. The manifold 60 is structured with an inlet 74 which is in fluid communication with a space 76 formed between the pitot tube arm 78 and the manifold 60. Fluid entering the inlet 74 and through the space 76 is directed into fluid channels 80 formed in the rotor cover 64. The fluid empties into the rotor chamber 82. As the rotor assembly 50 rotates during operation of the pump, the fluid is urged toward the circumferential wall 84 of the rotor assembly 50 under centrifugal force. Fluid impacts the inlet 86 of the pitot tube 70 and moves through the pitot tube 70 into the central bore 88 of the pitot tube arm 78 toward the outlet 89 formed in the manifold 60.

Figure 3:
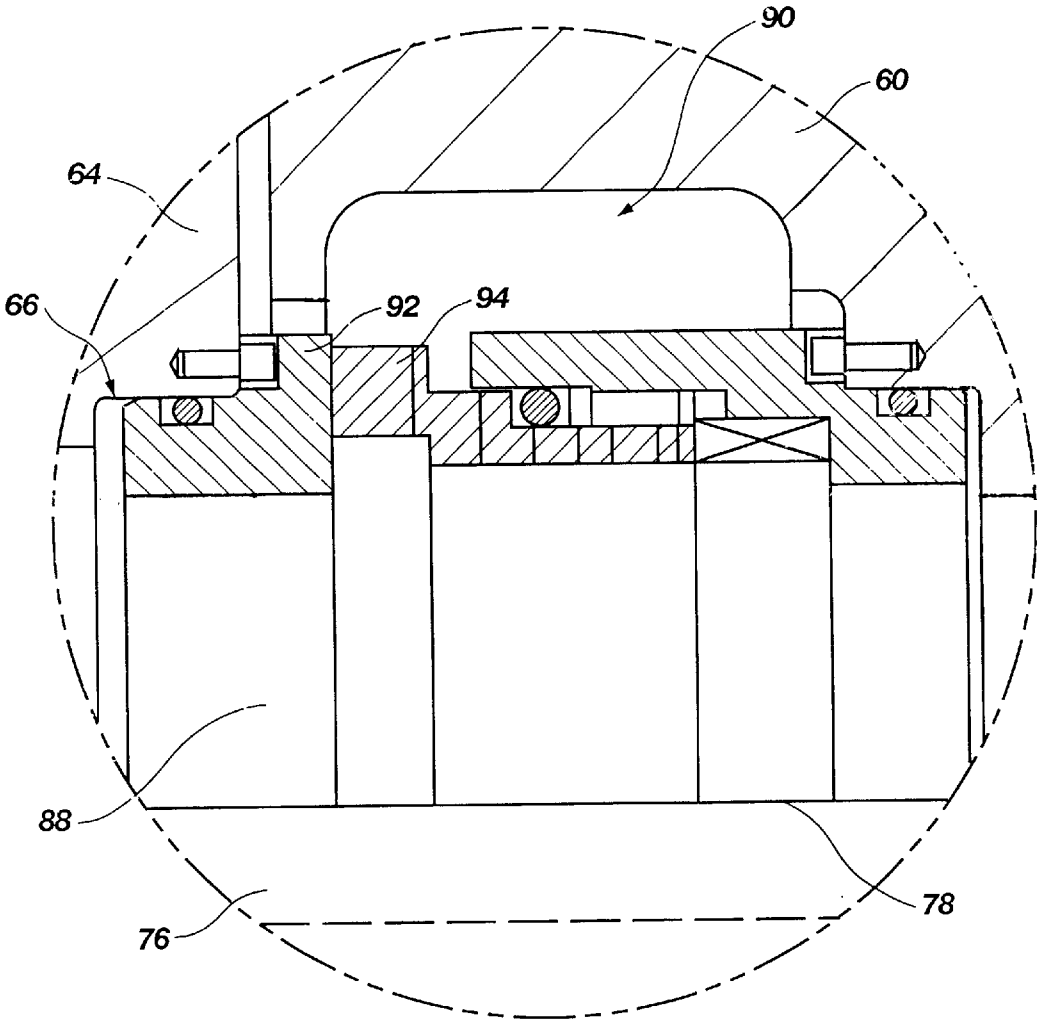
FIG. 3 is an enlarged view in longitudinal cross section of the sealing components associated with the rotor cover and manifold of the pump casing.

A fluid-tight seal is maintained between the rotor cover 64 and the manifold 60 by means of a seal assembly 90, as shown generally in FIG. 2. FIG. 3 illustrates more clearly in an enlarged view of the seal assembly 90 that a first seal member 92 surrounds the opening 66 of the rotor cover 64 and is attached thereto. The first seal member 92 rotates with the rotor cover 64 as the rotor assembly moves. A second seal member 94 surrounds the arm 78 of the pitot tube assembly 68 and registers against the first seal member 92. The second seal member 94 is stationary. It can best be understood by reference to FIG. 3 that when the rotor cover is subject to deflection, pressures are concomitantly exerted by the outwardly deflected rotor cover on the seals. The axial movement thus exerted accelerates degradation of the seals and adversely affects maximum rotational speeds and suction pressures.

As described to this point, the rotor assembly 50 of the present invention is comprised of the structural elements essentially found in conventional rotor assemblies. However, the rotor assembly 50 of the present invention differs significantly from conventional rotor assemblies in being especially configured to counterbalance the centrifugal forces and suction pressures which cause deleterious deflection in conventional rotor assemblies as previously described. Accordingly, FIGS. 4–9 illustrate alternative embodiments of the rotor assembly of the present invention which are each configured to lessen or prevent axial deflection in the rotor assembly.

Figure 4:
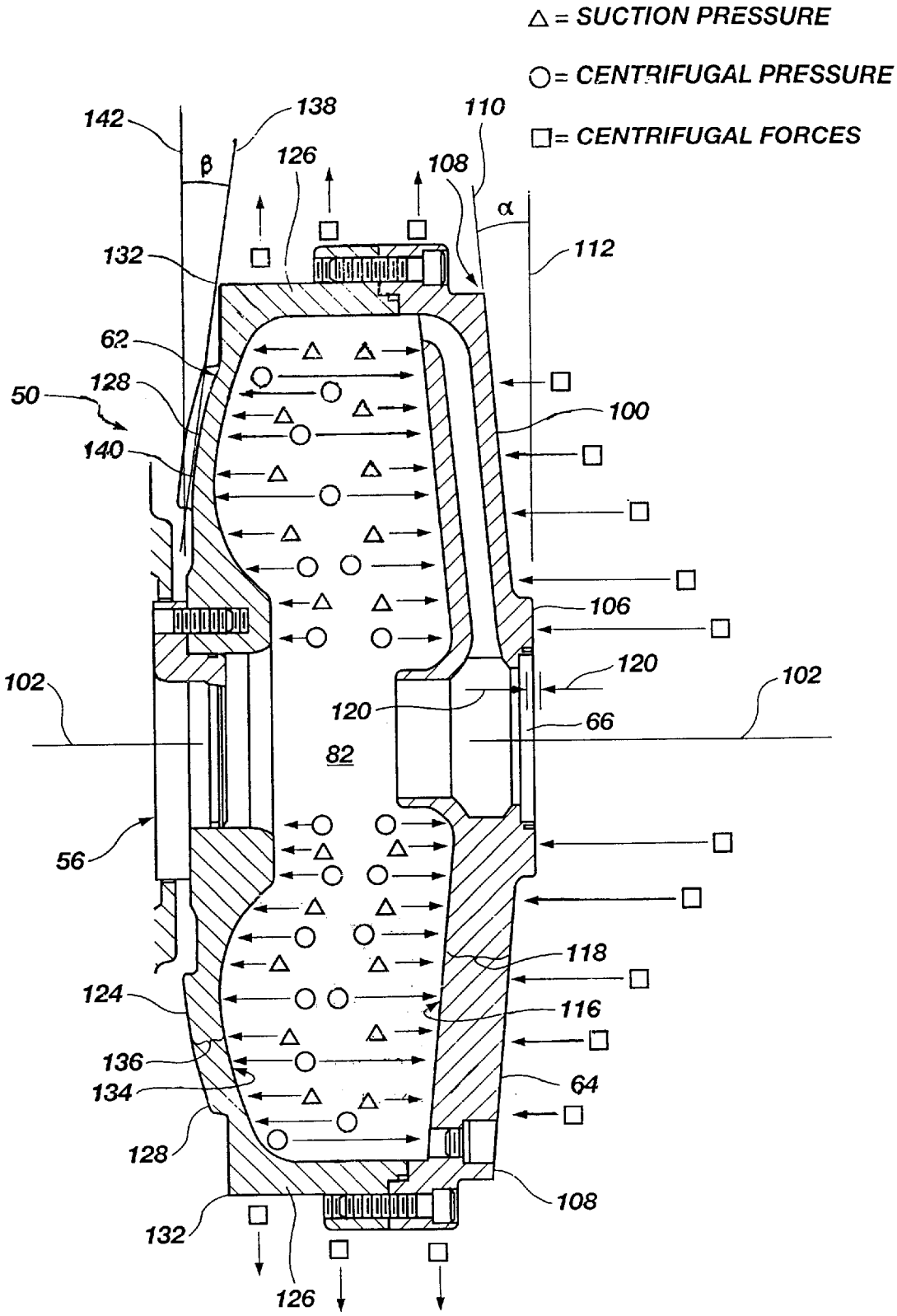
FIG. 4 is a schematic representation of the rotor assembly shown in FIG. 2 illustrating the configuration of the rotor assembly and the counterbalancing effects achieved in overcoming the centrifugal forces exerted on the rotor assembly during high speed operation.

FIG. 4 illustrates a first embodiment of the rotor assembly 50 of the present invention, and further illustrates schematically how the configuration of the rotor assembly 50 counterbalances centrifugal pressures and forces. In the embodiment illustrated in FIG. 4, the rotor cover 64 is configured to be non-planar. As used herein, non-planar means that the outer surface 100 of the rotor cover 64 is configured to lie in a plane which is other than perpendicular to a plane extending along the central axis 102 of the rotor assembly 50. As described more fully below, the rotor member 62 may also be configured to be non-planar in accordance with the present invention. In the embodiment shown in FIG. 4, the rotor cover 64 is conically-shaped in that the outer surface 100 of the rotor cover 64 extends from near the hub 106 of the rotor cover 64 (i.e., that portion of the rotor cover 64 immediately surrounding the opening 66) to a peripheral edge 108 of the rotor cover 64 and slopes in the direction of the rotor member 62. Thus, the outer surface 100 of the rotor cover 62 defines a plane 110 which is angled from a perpendicular plane 112, defined relative to the central axis 102 of the rotor assembly 50.

The angle $\alpha$ between the plane 110 of the rotor cover 64 and the perpendicular plane 112 may, most suitably, vary between about 2° and about 28°, as described more fully below. Preferably, the inner surface 116 of the rotor cover 64 lies in a plane which is substantially parallel to the plane 110 of the outer surface 100 of the rotor cover 64, thereby defining a thickness 118 of the rotor cover 64 which remains substantially constant in dimension from a point near the hub 106 of the rotor cover 64 to near the peripheral edge 108 of the rotor cover 64. The non-planar configuration of the rotor cover 64 in the embodiment shown in FIG. 4 facilitates the formation of centrifugal forces, as illustrated, which exert pressure inwardly on the rotor cover 64 in the direction of the rotor member 62. As centrifugal pressures and suction forces increase within the rotor chamber 82, the configuration of the rotor cover 64 effectively cancels the suction pressures and centrifugal pressures and forces exerted from within the rotor chamber 82 by the fluid, resulting in little or no deflection of the rotor cover 62, as characterized by arrows 120.

Further, in the embodiment of the invention shown in FIG. 4, the rotor member 62, comprising an end wall 124 and an upstanding circumferential wall 126 extending from the end wall 124, is structured with a non-planar end wall 124. As shown, the end wall 124 has an outer surface 128 which extends from near the drive shaft 56 attachment to near the peripheral edge 132 of the rotor member 62 and curves in the direction of the rotor cover 64. Again, it is preferable that the inner surface 134 of the end wall 124 be structured with substantially the same curvature as the outer surface 128 to provide a wall thickness 136 which is substantially constant in dimension from a point near the drive shaft 56 attachment to a point near the peripheral edge 132. A plane 138, defined by a tangent line drawn through the peripheral edge 132 of the rotor member 64 and an outermost point 140 on the curvature of the end wall 128, is angled from a plane 142 oriented perpendicularly to a plane formed through the central axis 102 of the rotor assembly 50. The angle $\beta$ between plane 138 and plane 142 may vary between about 10° to about 28°.

Figure 5:
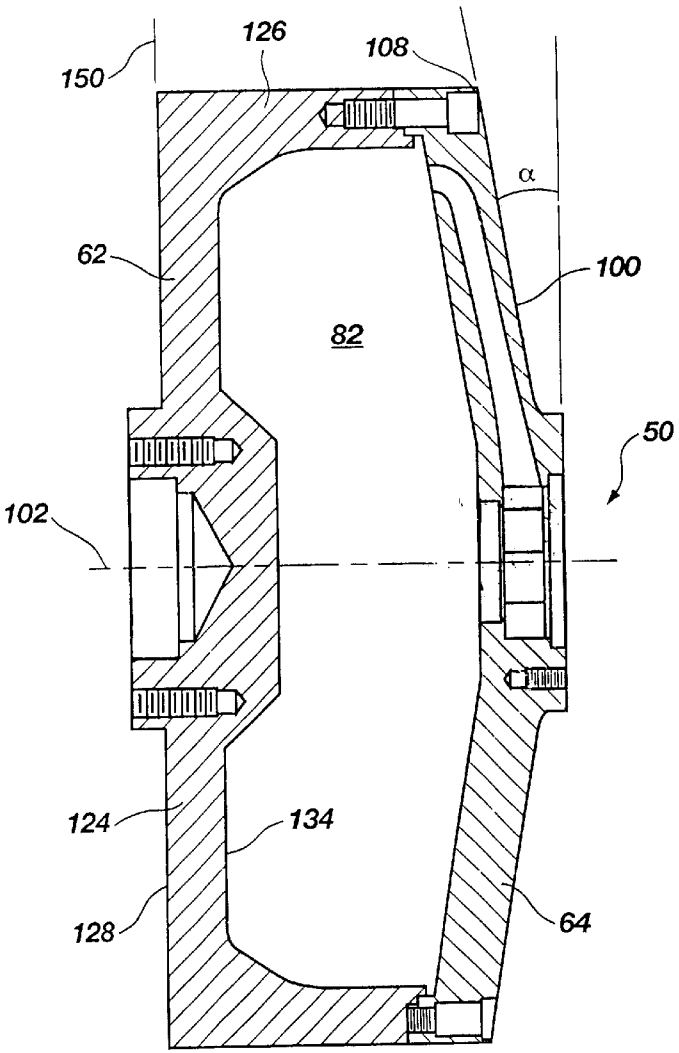
FIG. 5 is a schematic representation of a second embodiment of the present invention having a conically-shaped rotor cover and a flat end wall.

FIG. 5 illustrates a second embodiment of the rotor assembly 50, the configuration of which is also specially designed to counterbalance the centrifugal and suction pressures exerted on the rotor assembly 50 from within the rotor chamber 82. In this embodiment, the rotor cover 64 is generally conical in shape, the outer surface 100 of the rotor cover 64 being angled in the direction of the rotor member 64. The end wall 124 of the rotor member 62 is planar, however, having the outer surface 128 of the rotor member 62 lying in a plane 150 which is perpendicular in orientation relative to a plane formed along the central axis 102 of the rotor assembly 50. While the planar configuration of the end wall 124 is subject to some deflection resulting from centrifugal forces exerted on the circumferential wall 126 of the rotor assembly 50 during operation, the non-planar configuration of the rotor cover 64 effectively counterbalances the forces and pressures exerted from within the rotor chamber 82 to lessen overall deflection or displacement of the rotor assembly 50.

Figure 6:
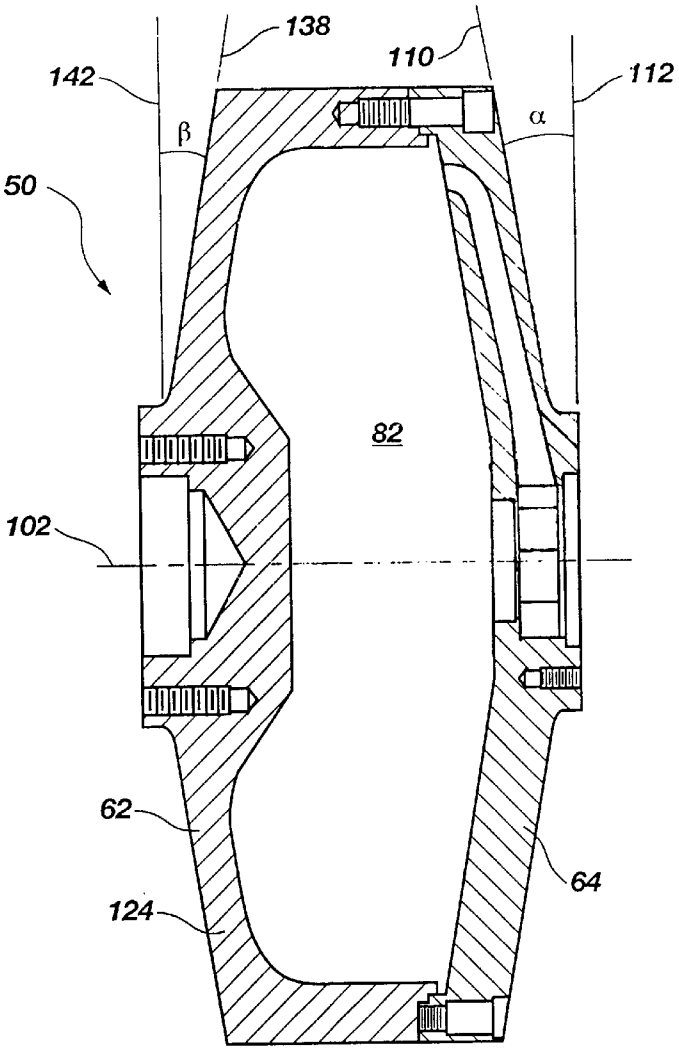
FIG. 6 is a schematic representation of a third embodiment of the present invention having a conically-shaped rotor cover and a conically-shaped end wall.

FIG. 6 illustrates a third embodiment of the rotor assembly 50 of the invention where rotor cover 64 is conically-shaped and the end wall 124 is conically-shaped as well. In this embodiment, the configuration of both the rotor cover 64 and the end wall 124 of the rotor assembly 50 contribute to the formation of centrifugal forces on the outside of the end wall 124 and rotor cover 64 which counterbalance forces exerted from within the rotor chamber 82. The embodiment of the rotor assembly shown in FIG. 6 may be an especially suitable configuration for use in centrifugal pumps of the pitot tube type.

Figure 7:
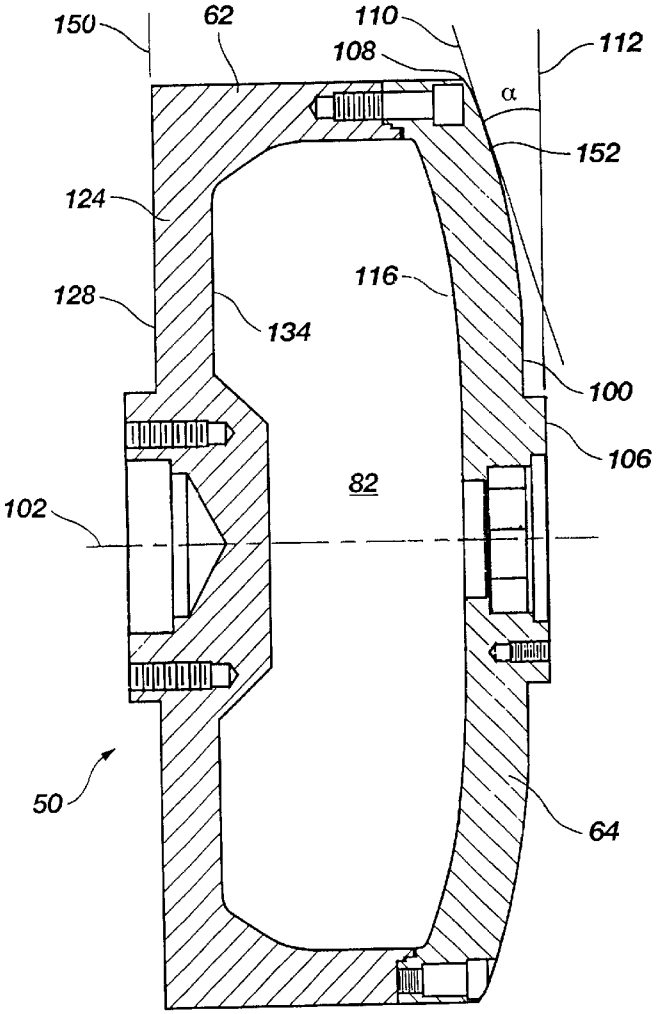
FIG. 7 is a schematic representation of a fourth embodiment of the present invention having a curved rotor cover and a flat end wall.

FIG. 7 illustrates a fourth embodiment of the rotor assembly 50 of the present invention where the rotor cover 64 is curved and the end wall 124 of the rotor member 62 is planar. More specifically, the outer surface 100 of the rotor cover 64 is curved from a point near the hub 106 of the rotor cover 64 to near the peripheral edge 108 of the rotor cover 64 and is curved in the direction of the rotor member 62. A plane 110 defined by a tangent line drawn through the peripheral edge 108 and a point 152 on the curve of the outer surface 100 is angled from a plane 112 in perpendicular orientation relative to the central axis 102 of the rotor assembly 50. The angle $\alpha$ between plane 110 and plane 112 may vary from between about 2° and about 28°. The curved configuration of the rotor cover 64 facilitates the formation of centrifugal forces pressing on the outer surface 110 of the rotor cover 64 during operation which counterbalances the forces exerted from within the rotor chamber 82.

Figure 8:
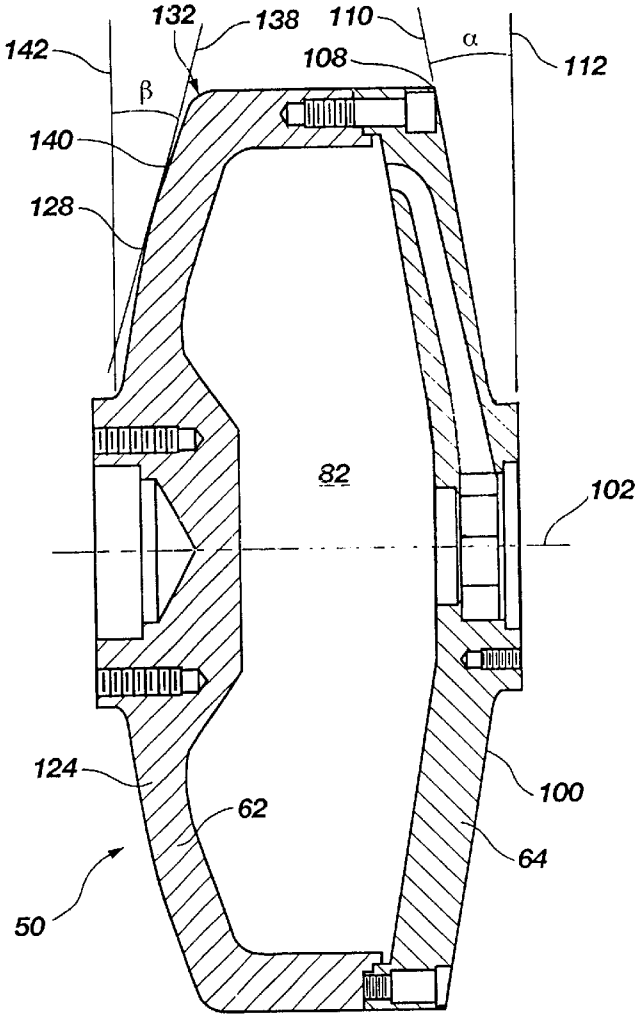
FIG. 8 is a schematic representation of a fifth embodiment of the present invention having a curved rotor cover and a conically-shaped end wall.

FIG. 8 illustrates a fifth embodiment of the rotor assembly 50 of the present invention where the rotor cover 64 is conically-shaped and the end wall 124 of the rotor member 62 is curved. Both the conical shape of the rotor cover 64 and the curved configuration of the end wall 124 facilitate the formation of centrifugal forces against the outer surface 100, 128 of the rotor cover 64 and end wall 124, respectively, to limit or prevent deflection in the rotor assembly 50. Again, the angle $\alpha$ of the non-planar rotor cover 64 may be between 2° and 28°, and the angle $\beta$ of the end wall 124 may be between 10° and 28°.

Figure 9:
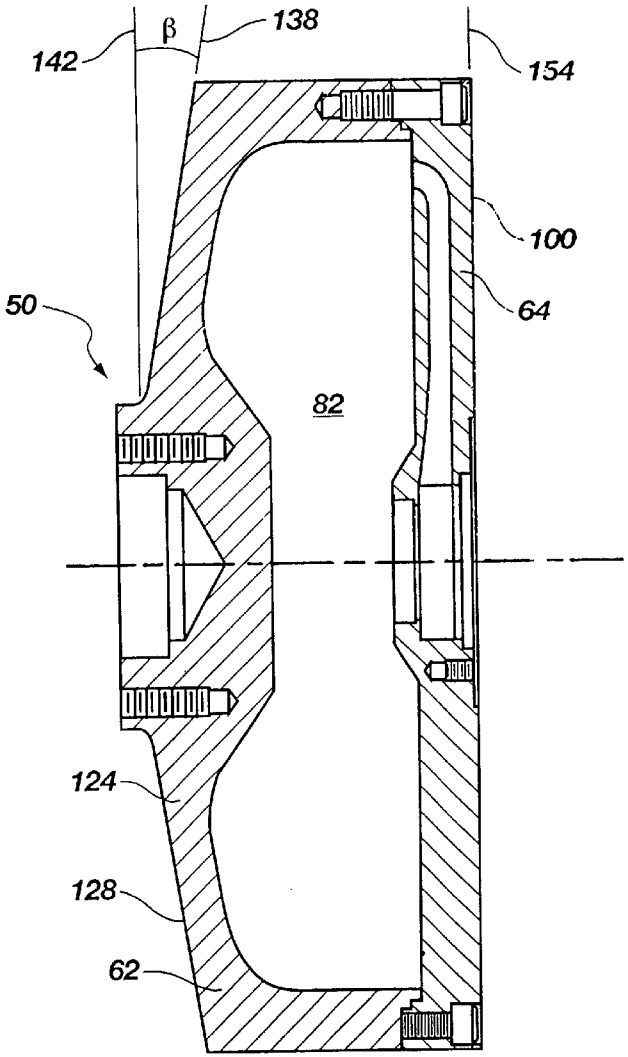
FIG. 9 is a schematic representation of a sixth embodiment of the present invention having a flat rotor cover and a conically-shaped end wall.

In a sixth embodiment of the rotor assembly 50 shown in FIG. 9, the formation of beneficial centrifugal forces to counterbalance the forces exerted from within the rotor chamber 82 may be achieved by providing a rotor assembly 50 having a planar rotor cover 64 and a conically-shaped end wall 124 of the rotor member 82. More specifically, the outer surface 100 of the rotor cover 64 may lie in a plane 154 which is perpendicular in orientation relative to a plane extending along the central axis 102 of the rotor assembly 50, a configuration which is, in itself, not typically conducive to the formation of counterbalancing forces on the rotor cover 64. However, the conical shape of the end wall 124 produces counterbalancing forces on the end wall 124 which effectively reduce the centrifugal and suction forces exerted on the rotor cover 64 from within the rotor chamber 82, thereby limiting the amount of deflection experienced in both the rotor cover 64 and the end wall 124 of the rotor member 62.

From the several embodiments described herein, it is clear that certain uses and combinations of non-planar configurations in the rotor assembly of the present invention achieve the production of centrifugal forces directed against the rotor cover and/or the end wall of the rotor member in the direction of the rotor chamber, which effectively counterbalance the forces being exerted on the rotor assembly from within the rotor chamber. The counterbalancing of those forces by the various configurations herein described limit or prevent deflection of the rotor assembly, in both the rotor cover and the end wall of the rotor member.

It should be noted that in a curved rotor cover and/or end wall, in accordance with the present invention, the configuration of the curvature, as viewed in cross section, can vary. That is, the outer surface 100, 128 may be consistently arcuate from a point near the center axis 102 of the rotor assembly to near the peripheral edge 108, 132. Alternatively, for example, the outer surface 100, 128 may be conically-shaped from a point near the center axis 102 of the rotor assembly to a point midway between the center axis 102 and the peripheral edge 108, 132, then curve downwardly toward the peripheral edge 108, 132. Indeed, the curved configuration of the outer surface 100, 128 of the rotor cover 64 and end wall 124 can vary widely from the two examples described. However, the angle $\alpha$ and angle $\beta$ associated respectively with the non-planar configuration of the rotor cover 64 and end wall 62 of the rotor assembly 50, regardless of the configuration of the curvature, is preferably between about 2° and about 28° for the rotor cover 64 and between about 10° and about 28° for the end wall 124.

Figure 10:
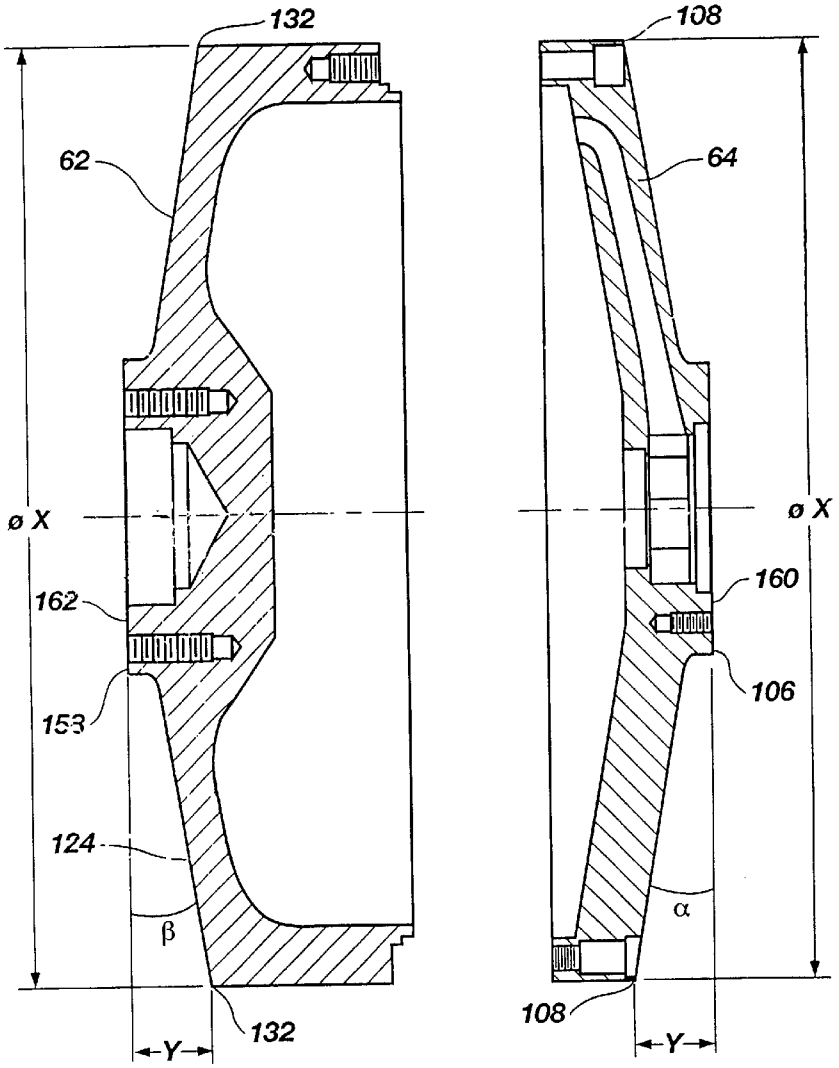
FIG. 10 is a chart illustrating a range of ratios of diameter to height in both the rotor cover and rotor member of the present invention.
Figure 11:
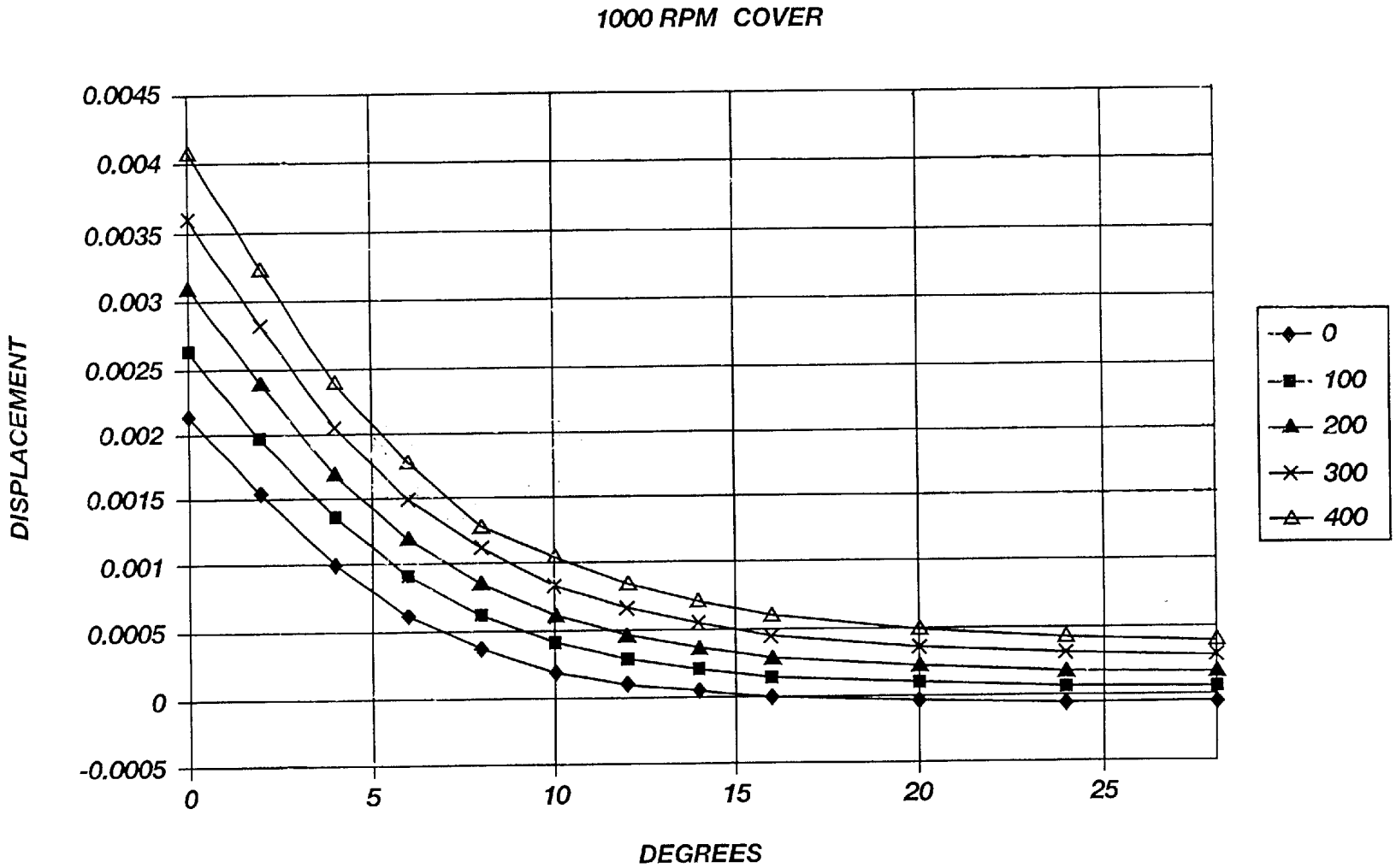
FIG. 11 is a graph illustrating conically-shaped rotor cover deflection rates at a 1000 rpm operational speed.
Figure 12:
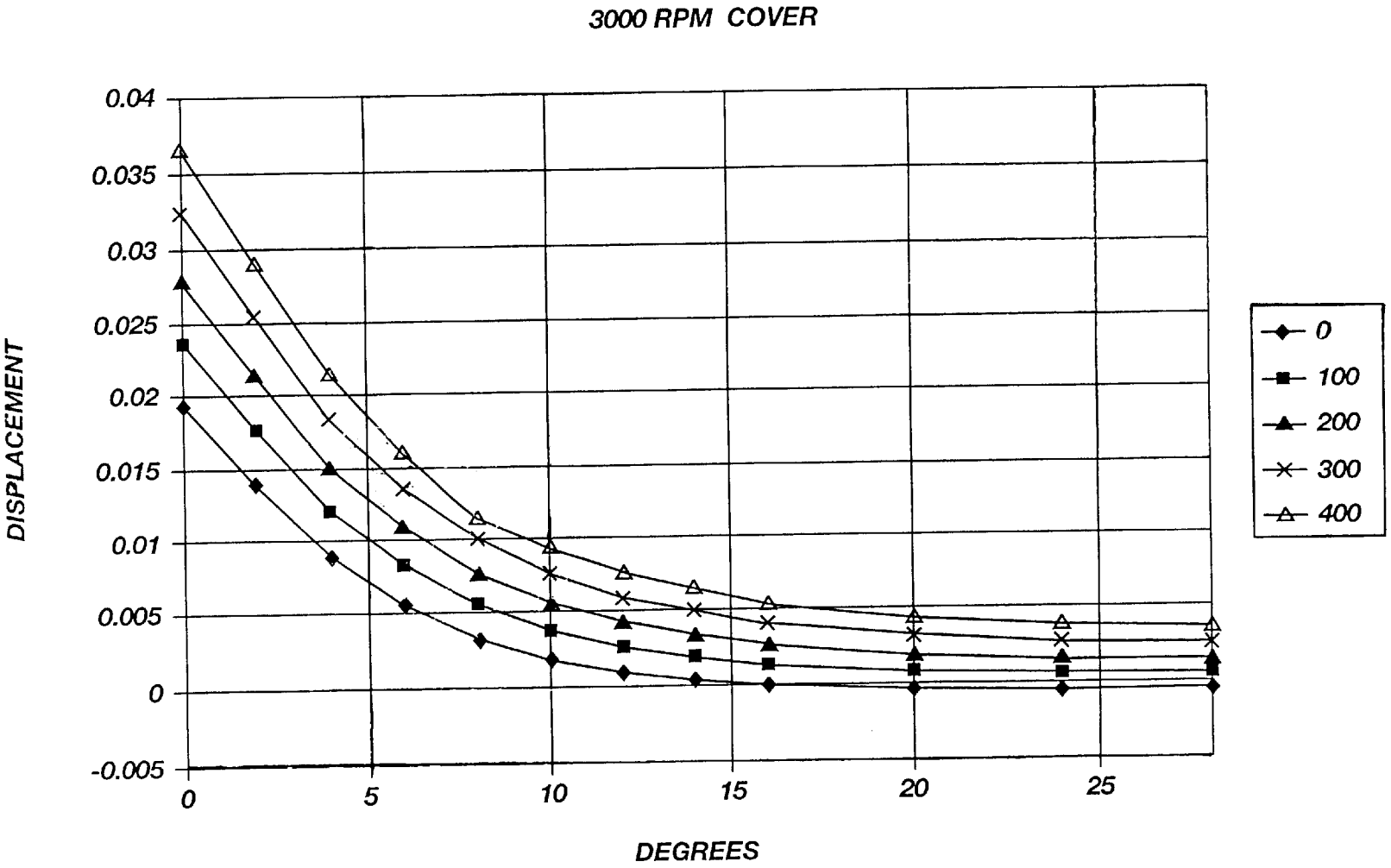
FIG. 12 is a graph illustrating non-planar rotor cover deflection rates at a 3000 rpm operational speed.
Figure 13:
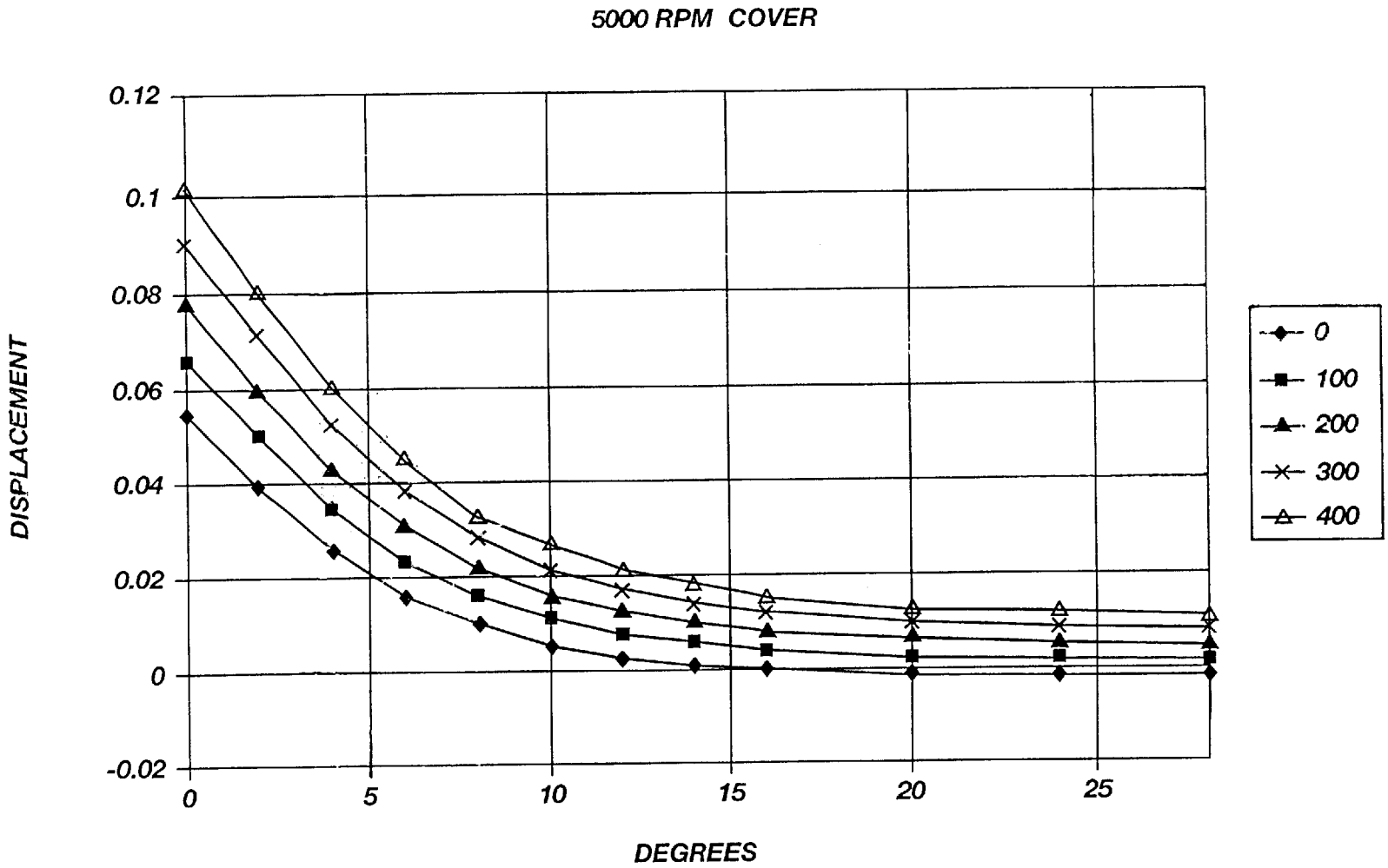
FIG. 13 is a graph illustrating non-planar rotor cover deflection rates at a 5000 rpm operational speed.
Figure 14:
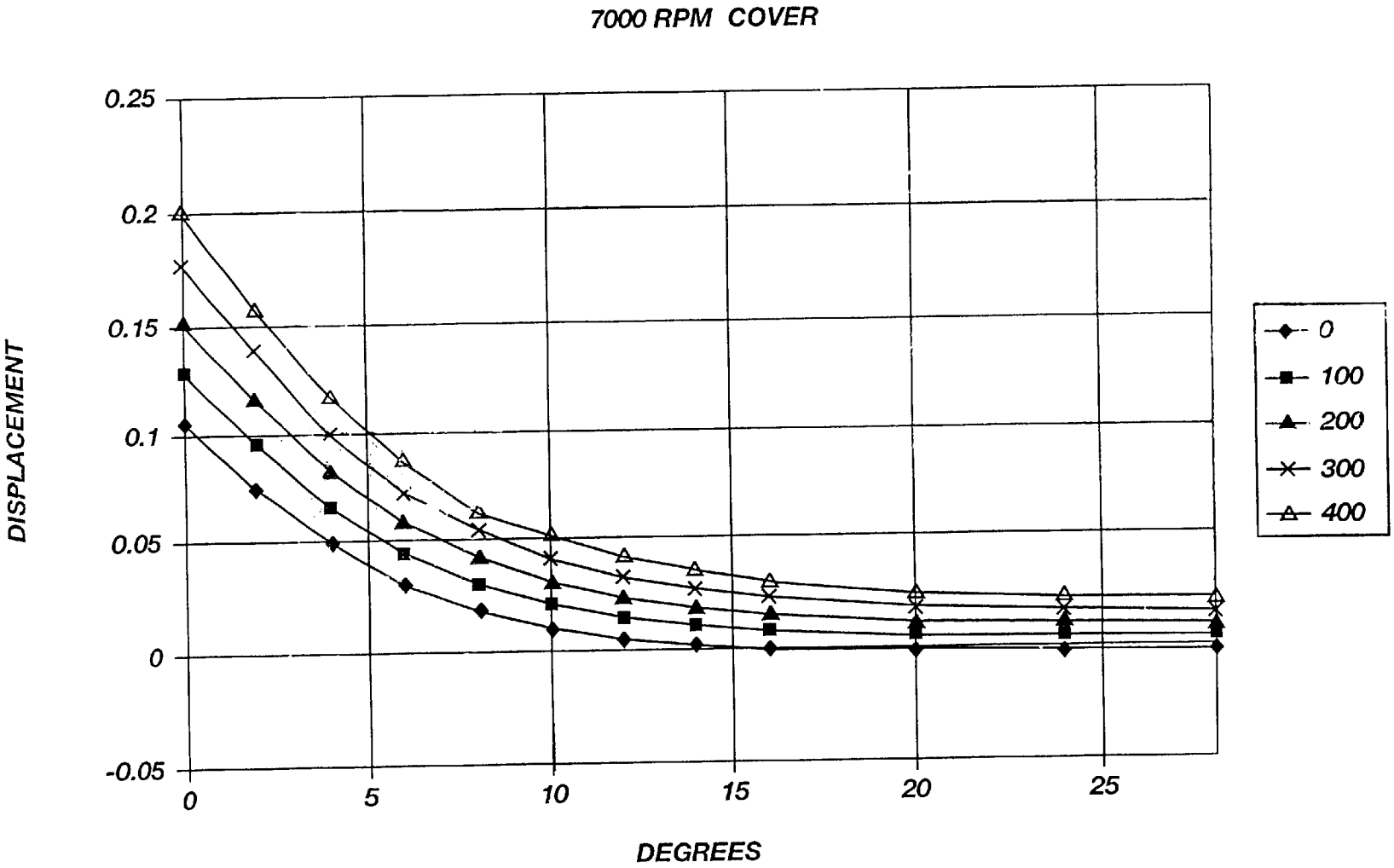
FIG. 14 is a graph illustrating non-planar rotor cover deflection rates at a 7000 rpm operational speed.
Figure 16:
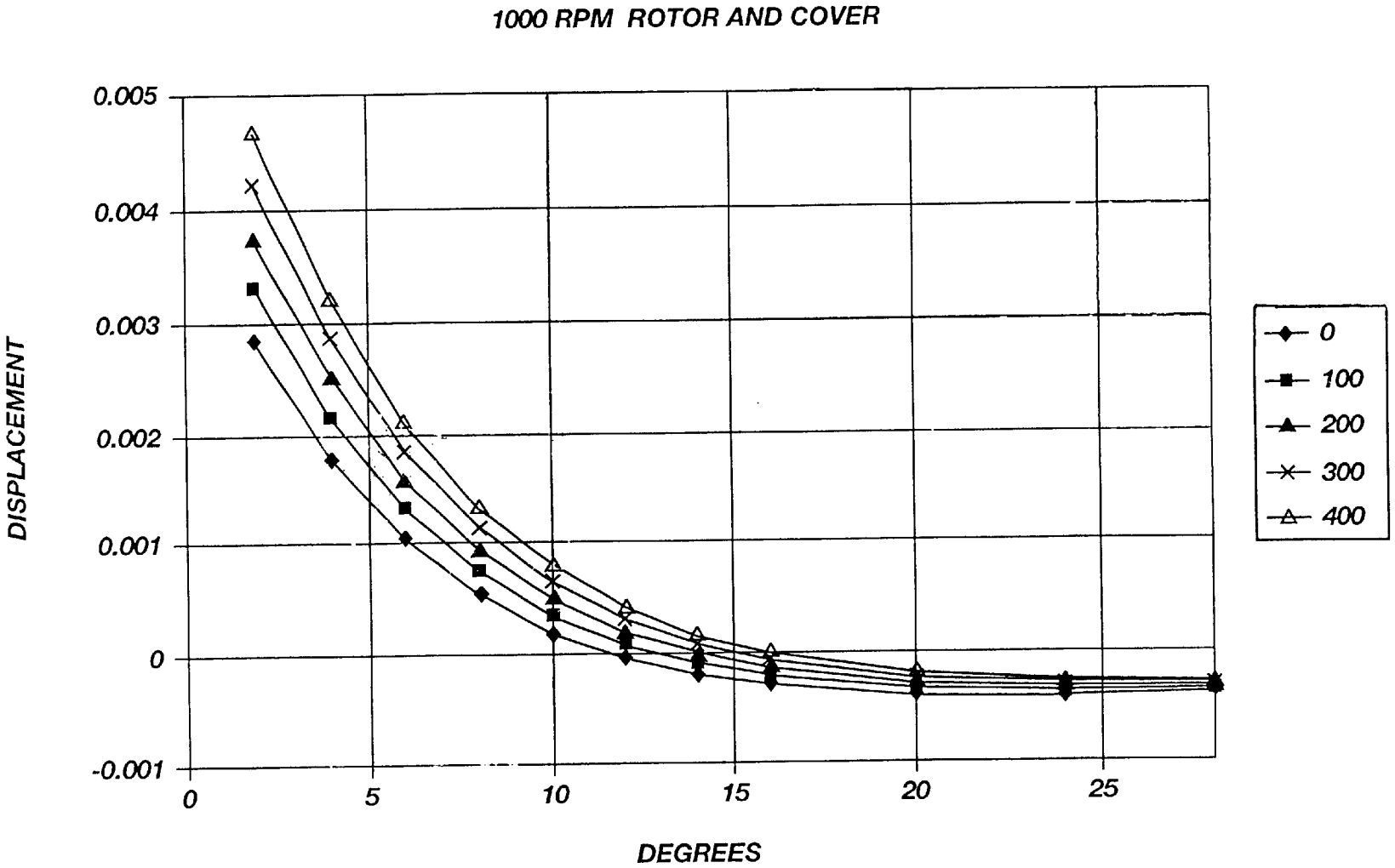
FIG. 16 is a graph illustrating rotor cover and rotor member deflection rates at a 1000 Rpm operational speed.
Figure 17:
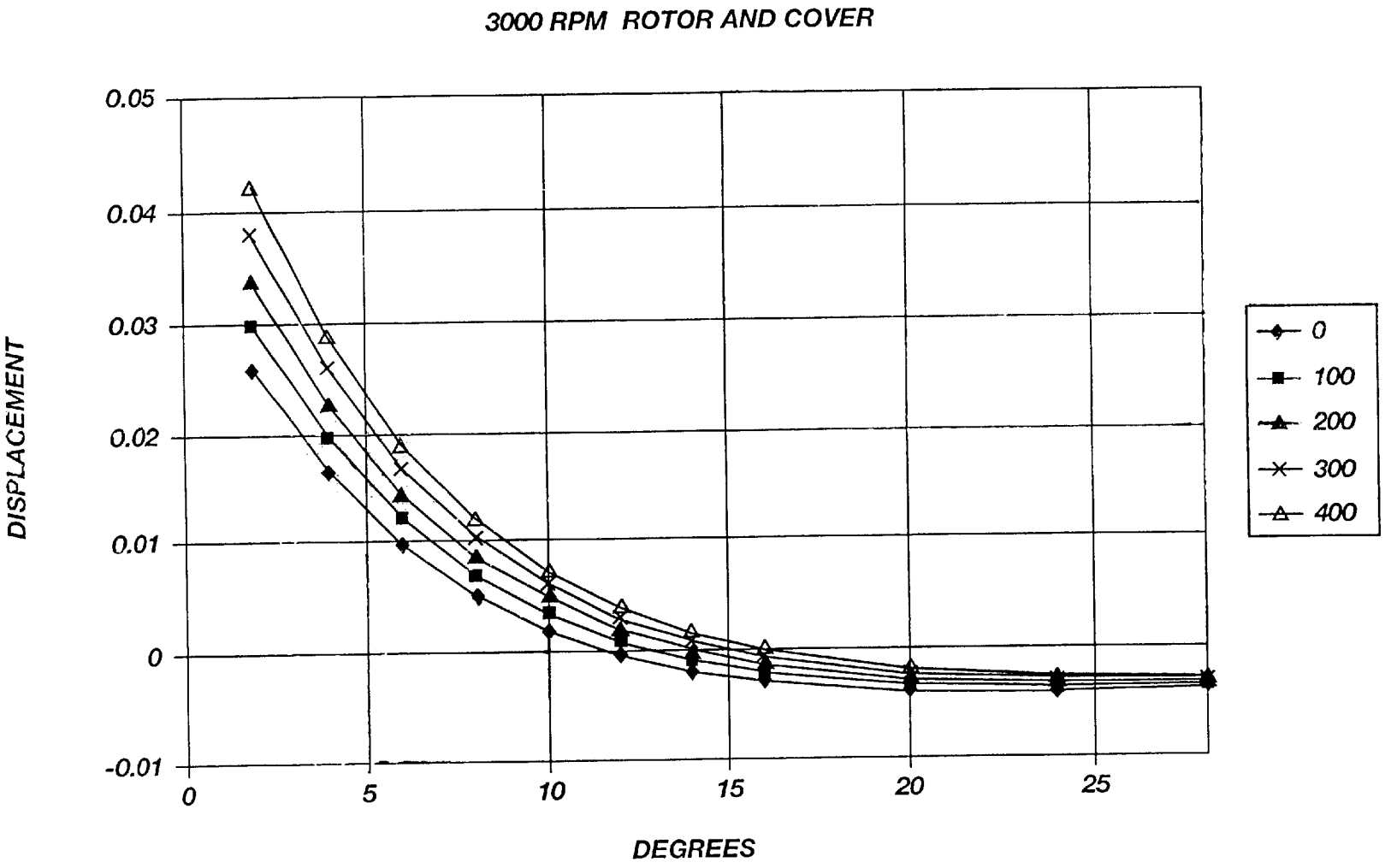
FIG. 17 is a graph illustrating non-planar rotor cover and non-planar rotor member deflection rates at a 3000 rpm operational speed.
Figure 18:
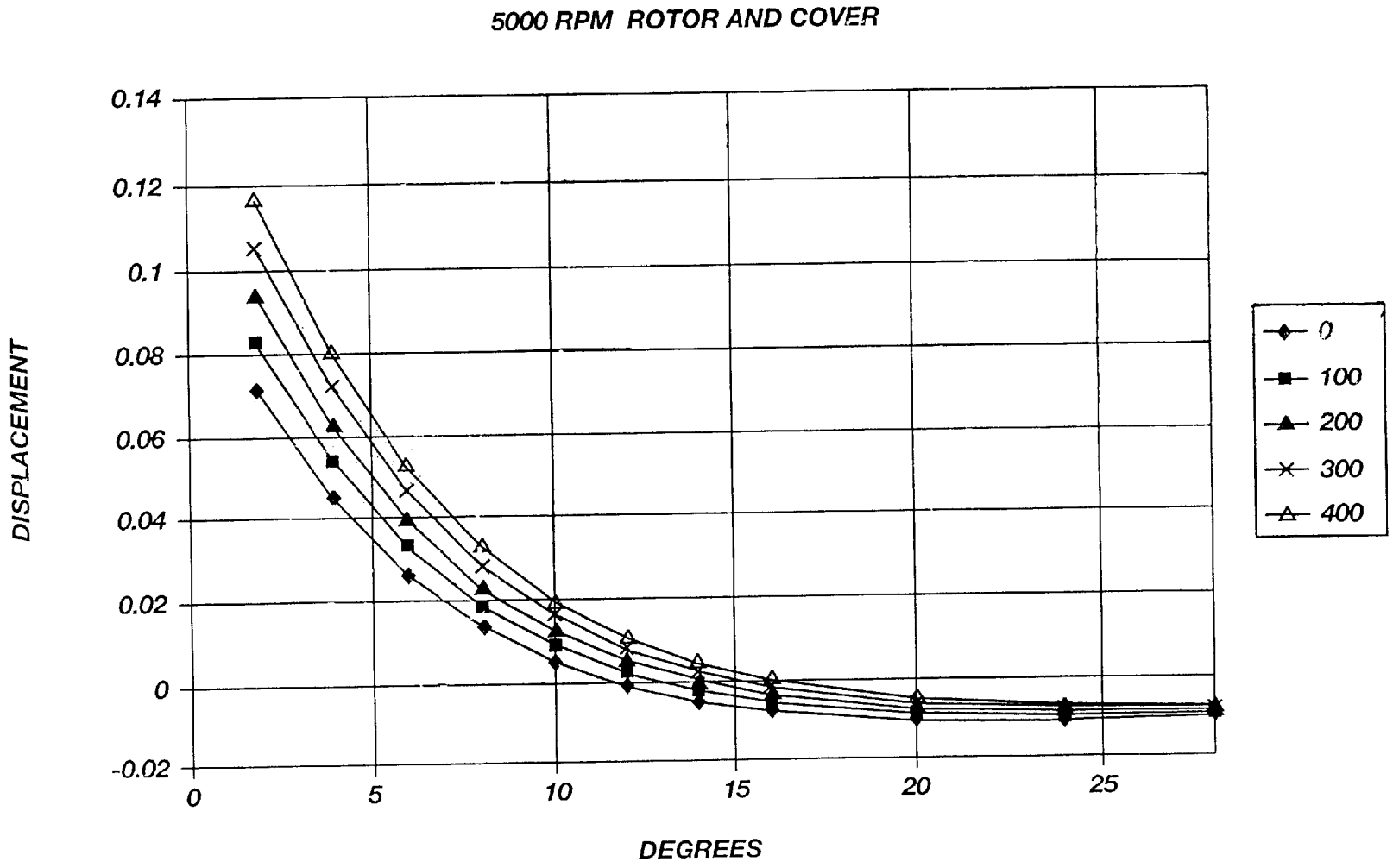
FIG. 18 is a graph illustrating non-planar rotor cover and non-planar rotor member deflection rates at a 5000 rpm operational speed.
Figure 19:
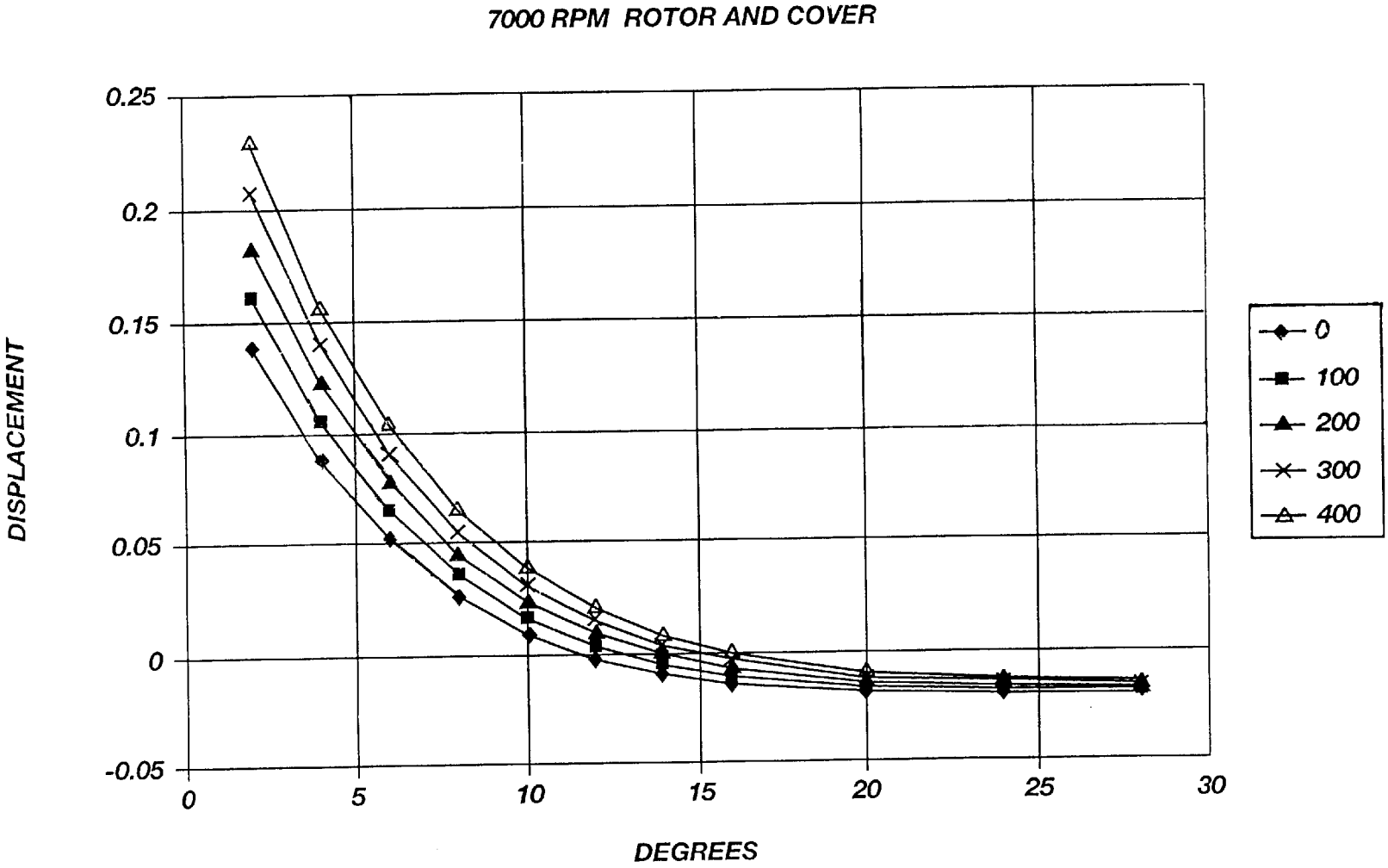
FIG. 19 is a graph illustrating non-planar rotor cover and non-planar rotor member deflection rates at a 7000 rpm operational speed.

Angle and curvature of the rotor cover and/or end wall of the rotor member will also vary with the size of the rotor assembly regardless of whether the outer surface 100, 128 is conically-shaped or curved. Hence, the angle of the rotor cover and end wall, as previously defined, may be alternatively expressed in terms of a ratio of height to diameter, as illustrated in FIG. 10. As shown, the diameter X of the rotor cover 64 is measured to the peripheral edge 108 of the rotor cover 64 and the height Y of the rotor cover 64 is measured from a perpendicular plane formed through the axially terminal point 160 of the hub 106 to a perpendicular plane formed through the peripheral edge 108 of the rotor cover 64. Thus, at an angle $\alpha$ of 8°, the ratio of the diameter X to the height Y of the rotor cover 64 is 14.23. Similarly, the diameter X of the end wall 124 of the rotor member 62 is measured from the peripheral edge 132 of the rotor member 62 and the height Y is measured from a perpendicular plane formed through the axially terminal point 162 of the hub 158 of the rotor member 62 to a perpendicular plane formed through the peripheral edge 132, as shown. Thus, when the angle $\beta$ is 14°, the ratio of the diameter X of the end wall 124 to the height Y of the end wall 124 is 8.02. The ratios provided in FIG. 10 are applicable to both conically-shaped and curved rotor covers or end walls.

Experimental data illustrating the decrease in deflection, or displacement, of the non-planar rotor cover achieved in the present invention are set forth in FIGS. 11–15. The graphs of FIGS. 11–14 illustrate that deflection or displacement of the rotor cover is significantly reduced or prevented in non-planar rotor cover configurations as compared with non-planar rotor covers (assuming the end wall of the rotor member to be planar) at both elevated suction pressures existing within the rotor chamber and at increased rotational speeds. For example, it can be seen that at 400 psi suction pressure and 1000 rpm, there is a 14.5% reduction in deflection in a rotor cover having an angle $\alpha$ of 16° in comparison with a rotor cover which is planar (0°). At 7000 rpm and 300 psi, there is a fifteen percent reduction in deflection or displacement in a rotor cover having an angle $\alpha$ of 14° in comparison with a rotor cover which is planar. The data illustrated in the graphs of FIGS. 11–14 are summarized in the table of FIG. 15. The table of FIG. 15 also illustrates the relative deflection or displacement rates of the rotor cover when expressed by ratio of rotor cover diameter X to height Y.

The data set forth in FIGS. 16–20 demonstrate relative deflection rates in the rotor cover and end wall of the rotor member when both are non-planar. It should be noted that the test data reflected in FIGS. 16–20 were derived from rotor assemblies where the angle of the rotor cover and the angle of the rotor member were the same. However, in practice, the angle of the rotor cover may differ from the angle of the rotor member. It can be seen from FIGS. 16–20 that deflection of the rotor cover and rotor member are significantly less when configured with a non-planar outer surface as compared to a planar rotor cover and planar rotor member. Deflection is especially lessened when the angle of the non-planar rotor cover and rotor member is between 8° and 16° at rotational speeds of from 1000 rpm to 7000 rpm. The data illustrated in FIGS. 16–19 are summarized in the table of FIG. 20. Further, the table of FIG. 20 illustrates relative deflection rates in terms of the ratio of diameter to height in the rotor cover and rotor member.

The rotor assembly of the present invention is particular designed with at least one non-planar outer surface in the rotor cover or rotor member, or both, to effectively counterbalance the forces and pressures exerted from within the rotor chamber and thereby lessen or negate deleterious deflections in the rotor assembly which compromise operation and lead to accelerated degradation of the seals. The rotor assembly of the present invention can be adapted to virtually any centrifugal pump. Hence, reference herein to specific details of the structure and function of the rotor assembly is by reference only and not by way of limitation. Those skilled in the art will recognize that changes may be made to the invention to adapt it to a variety of pumps and pump applications.

What is claimed is:

1. A rotor assembly for a pump comprising:

a rotor member having a hub, a central axis, a continuous peripheral edge radially spaced from said central axis and a continuous end wall extending radially from said hub to said peripheral edge;

a rotor cover connected to said rotor member having a hub, a central axis coaxial with said central axis of said rotor member, a peripheral edge radially spaced from said central axis of said rotor cover, a continuous outer surface extending radially from said hub of said rotor cover to near said peripheral edge thereof and an inner surface spaced from said outer surface defining a thickness therebetween, said thickness of said rotor cover being substantially uniform from a point near said hub thereof to said peripheral edge thereof;

a rotor chamber formed between said rotor member and said rotor cover into which fluid is directed for processing; and at least one of said end wall and said rotor cover being non-planar in configuration to reduce axial deflection of said end wall and said rotor cover.

2. The rotor assembly of claim 1 wherein said rotor member is non-planar and has a selected diameter and a selected height measured between a plane formed through the peripheral edge of said rotor member oriented perpendicularly to said central axis and a plane formed through an axially terminal point of said hub of said rotor member oriented perpendicularly to said central axis, said rotor member having a diameter to height ratio of between 3.76 to 11.34.

3. The rotor assembly of claim 1 wherein said rotor cover is non-planar and has a selected diameter and a selected height measured between a plane formed through the peripheral edge of said rotor member oriented perpendicularly to said central axis and a plane formed through an axially terminal point of said hub of said rotor cover oriented perpendicularly to said central axis, said rotor cover having a diameter to height ratio of between 3.76 to 57.28.

4. A rotor assembly for a pump comprising:

a rotor member having a hub, a central axis, a continuous peripheral edge radially spaced from said central axis and a continuous end wall extending radially from said hub to said peripheral edge;

a conically-shaped rotor cover connected to said rotor member having a hub, a central axis coaxial with said central axis of said rotor member, a peripheral edge radially spaced from said central axis of said rotor cover and a continuous outer surface extending radially from said hub of said rotor cover to near said peripheral edge thereof; and a rotor chamber formed between said rotor member and said rotor cover into which fluid is directed for processing.

5. The rotor assembly of claim 4 wherein said end wall is non-planar.

6. A rotor assembly for a pump comprising:

a rotor member having a hub, a central axis, a continuous peripheral edge radially spaced from said central axis and a continuous end wall extending radially from said hub to said peripheral edge;

a curved rotor cover connected to said rotor member having a hub, a central axis coaxial with said central axis of said rotor member, a peripheral edge radially spaced from said central axis of said rotor cover and a continuous outer surface extending radially from said hub of said rotor cover to near said peripheral edge thereof; and a rotor chamber formed between said rotor member and said rotor cover into which fluid is directed for processing.

7. The rotor assembly of claim 6 wherein said end wall is conically-shaped.

8. A rotor assembly for a pump comprising:

a rotor member having a hub, a central axis, a continuous peripheral edge radially spaced from said central axis and a continuous, conically-shaped end wall extending radially from said hub to said peripheral edge;

a rotor cover connected to said rotor member having a hub, a central axis coaxial with said central axis of said rotor member, a peripheral edge radially spaced from said central axis of said rotor cover and a continuous outer surface extending radially from said hub of said rotor cover to near said peripheral edge thereof; and a rotor chamber formed between said rotor member and said rotor cover into which fluid is directed for processing.

9. A rotor assembly for a pump comprising:

a rotor member having a hub, a central axis, a continuous peripheral edge radially spaced from said central axis and a continuous, curved end wall extending radially from said hub to said peripheral edge;

a rotor cover connected to said rotor member having a hub, a central axis coaxial with said central axis of said rotor member, a peripheral edge radially spaced from said central axis of said rotor cover and a continuous outer surface extending radially from said hub of said rotor cover to near said peripheral edge thereof; and a rotor chamber formed between said rotor member and said rotor cover into which fluid is directed for processing.

10. A rotor assembly for a pump comprising:

a rotor member having a hub, a central axis, a continuous peripheral edge radially spaced from said central axis and a continuous end wall extending radially from said hub to said peripheral edge;

a rotor cover connected to said rotor member having a hub, a central axis coaxial with said central axis of said rotor member, a peripheral edge radially spaced from said central axis of said rotor cover, a continuous outer surface extending radially from said hub of said rotor cover to near said peripheral edge thereof and an inner surface spaced from said outer surface, said inner surface being substantially parallel to said outer surface;

a rotor chamber formed between said rotor member and said rotor cover into which fluid is directed for processing; and at least one of said end wall and said rotor cover being non-planar in configuration to reduce axial deflection of said end wall and said rotor cover.

11. A rotor assembly for a centrifugal pump comprising:

a rotor member having a central axis, a continuous peripheral edge radially spaced from said central axis and a continuous end wall extending radially from said central axis to said peripheral edge;

a rotor cover connected to said rotor member and having a central axis coaxial with said central axis of said rotor member, a continuous peripheral edge radially spaced from said central axis of said rotor cover and a continuous outer surface extending radially from near said central axis of said rotor cover to near said peripheral edge of said rotor cover, said outer surface being conically-shaped, sloping outwardly and downwardly toward said rotor member; and a rotor chamber formed between said rotor member and said rotor cover into which fluid is directed for processing.

12. The rotor assembly of claim 11 wherein said end wall of said rotor member is planar.

13. The rotor assembly of claim 11 wherein said end wall of said rotor member is conically-shaped, sloping from near said central axis of said rotor member to near said peripheral edge of said rotor member in a direction toward said rotor cover.

14. The rotor assembly of claim 11 wherein said end wall of said rotor member is curved from near said central axis of said rotor member to near said peripheral edge of said rotor member in a direction toward said rotor cover.

15. The rotor assembly of claim 11 wherein said outer surface of said rotor cover defines a plane which is oriented at an angle of between about 2° and about 28° from a plane extending in a perpendicular orientation to a plane formed along said central axis.

16. A rotor assembly for a centrifugal pump comprising:

a rotor member having a central axis, a peripheral edge radially spaced from said central axis and an end wall extending radially from said central axis to said peripheral edge;

a rotor cover connected to said rotor member and having a central axis coaxial with said central axis of said rotor member, a peripheral edge radially spaced from said central axis of said rotor cover and an outer surface extending radially from near said central axis of said rotor cover to near said peripheral edge thereof, said outer surface being curved in a direction from near said central axis to near said peripheral edge in a direction toward said rotor member being formed with at least one radially extending inlet fluid channel; and a rotor chamber formed between said rotor member and said rotor cover into which fluid is directed for processing.

17. The rotor assembly of claim 16 wherein said end wall of said rotor member is planar.

18. The rotor assembly of claim 16 wherein said end wall of said rotor member slopes from near said central axis of said rotor member to near said peripheral edge of said rotor member in a direction toward said rotor cover.

19. The rotor assembly of claim 14 wherein a tangent plane formed through a terminal point on said peripheral edge and an outermost point on said curved outer surface of said rotor cover is oriented at an angle of between about 2° and about 28° from a plane extending in a perpendicular orientation to a plane formed along said central axis.

20. A rotor assembly for a centrifugal pump comprising:

a rotor member having a central axis, a continuous peripheral edge radially spaced from said central axis and a continuous end wall extending radially from said central axis to said peripheral edge, and sloping from said near said central axis to near said peripheral edge at an angle to a plane oriented perpendicularly to a plane formed through said central axis;

a rotor cover connected to said rotor member and having a central axis coaxial with said central axis of said rotor member, a peripheral edge radially spaced from said central axis of said rotor cover and a continuous outer surface extending radially from near said central axis of said rotor cover to near said peripheral edge of said rotor cover, said outer surface sloping outwardly and downwardly toward said rotor member at an angle to a plane oriented perpendicularly to a plane formed through said central axis; and a rotor chamber formed between said rotor member and said rotor cover into which fluid is directed for processing.

21. The rotor assembly of claim 20 wherein said angle of said end wall is between about 10° and about 28°, and said angle of said outer surface of said rotor cover is between about 2° and about 28°.

22. The rotor assembly of claim 20 wherein said rotor cover and has a selected diameter and a selected height measured between a plane formed through the peripheral edge of said rotor member oriented perpendicularly to said central axis and a plane formed through an axially terminal point of a hub of said rotor cover oriented perpendicularly to said central axis, said rotor cover having a diameter to height ratio of between 3.76 to 57.28 and further wherein said rotor member has a selected diameter and a selected height measured between a plane formed through the peripheral edge of said rotor member oriented perpendicularly to said central axis and a plane formed through an axially terminal point of a hub of said rotor member oriented perpendicularly to said central axis, said rotor member having a diameter to height ratio of between 3.76 to 11.34.

23. A rotor assembly for a pump comprising:

a rotor member having a hub, a central axis, a peripheral edge radially spaced from said central axis and an end wall extending radially from said hub to said peripheral edge;

a rotor cover connected to said rotor member having a hub, a central axis coaxial with said central axis of said rotor member, a peripheral edge radially spaced from said central axis of said rotor cover and an outer surface extending and radially curving from said hub of said rotor cover to near said peripheral edge thereof; and a rotor chamber formed between said rotor member and said rotor cover into which fluid is directed for processing.

24. The rotor assembly of claim 23 wherein said end wall is conically-shaped.

25. A rotor assembly for a centrifugal pump comprising:

a rotor member having a central axis, a peripheral edge radially spaced from said central axis and a substantially planar end wall extending radially from said central axis to said peripheral edge;

a rotor cover connected to said rotor member and having a central axis coaxial with said central axis of said rotor member, a peripheral edge radially spaced from said central axis of said rotor cover and an outer surface extending radially from near said central axis of said rotor cover to near said peripheral edge of said rotor cover, said outer surface being conically-shaped, sloping outwardly and downwardly toward said rotor member; and a rotor chamber formed between said rotor member and said rotor cover into which fluid is directed for processing.

26. A rotor assembly for a centrifugal pump comprising:

a rotor member having a central axis, a peripheral edge radially spaced from said central axis and an end wall extending and radially sloping from near said central axis to near said peripheral edge;

a rotor cover connected to said rotor member and having a central axis coaxial with said central axis of said rotor member, a peripheral edge radially spaced from said central axis of said rotor cover and an outer surface extending radially from near said central axis of said rotor cover to near said peripheral edge thereof, said outer surface being curved in a direction from near said central axis to near said peripheral edge in a direction toward said rotor member; and a rotor chamber formed between said rotor member and said rotor cover into which fluid is directed for processing.

* * * * *